US008427513B2

(12) United States Patent
Shidara et al.

(10) Patent No.: US 8,427,513 B2
(45) Date of Patent: Apr. 23, 2013

(54) DISPLAY DEVICE, DISPLAY DEVICE DRIVE METHOD, AND COMPUTER PROGRAM

(75) Inventors: Hidehiko Shidara, Tokyo (JP); Ken Kikuchi, Tokyo (JP); Yasuo Inoue, Tokyo (JP); Masahiro Ito, Kanagawa (JP); Hideto Mori, Tokyo (JP)

(73) Assignee: Sony Corporation, Tokyo (JP)

( * ) Notice: Subject to any disclaimer, the term of this patent is extended or adjusted under 35 U.S.C. 154(b) by 183 days.

(21) Appl. No.: 12/598,929

(22) PCT Filed: May 15, 2008

(86) PCT No.: PCT/JP2008/058950

§ 371 (c)(1),
(2), (4) Date: Nov. 5, 2009

(87) PCT Pub. No.: WO2008/143134

PCT Pub. Date: Nov. 27, 2008

(65) Prior Publication Data

US 2010/0134535 A1 Jun. 3, 2010

(30) Foreign Application Priority Data

May 18, 2007 (JP) ..... 2007-133228

(51) Int. Cl.
*G09G 5/10* (2006.01)
*G09G 3/30* (2006.01)

(52) U.S. Cl.
USPC ..... 345/690; 345/77

(58) Field of Classification Search ..... 345/690
See application file for complete search history.

(56) References Cited

U.S. PATENT DOCUMENTS 6,873,308 B2 3/2005 Sagano et al.
6,952,193 B2 * 10/2005 Abe et al. ..... 345/87
6,987,521 B2 * 1/2006 Mori et al. ..... 345/690
(Continued)

FOREIGN PATENT DOCUMENTS

EP 1 164 562 A2 12/2001
EP 1 310 935 A2 5/2003
(Continued)

OTHER PUBLICATIONS

Supplementary European Search Report issued Feb. 3, 2011 in EP 08 75 2808.

(Continued)

*Primary Examiner* — Dorothy Harris
(74) *Attorney, Agent, or Firm* — Oblon, Spivak, McClelland, Maier & Neustadt, L.L.P.

(57) ABSTRACT

A display device is provided which includes: a still image detection unit (122) which inputs video signals having linear characteristic and calculates an average value of signal levels of the video signals having linear characteristic per pixel; a storage unit (150) which successively stores the average values calculated by the still image detection unit (122); a still image judging unit (162) which judges whether a still image is displayed on a present screen based on a difference between the average value stored in the storage unit (150) and the last average value; a coefficient calculation unit (164) which calculates coefficients for reducing luminance of an image to be displayed when the still image judging unit (162) has judged that a still image is displayed on the present screen; and a signal level correction unit (128) which multiplies the video signals by the coefficients calculated by the coefficient calculation unit (164).

18 Claims, 27 Drawing Sheets

U.S. PATENT DOCUMENTS

| | | | | |
|---|---|---|---|---|
| 7,139,008 | B2 * | 11/2006 | Mori et al. | 345/690 |
| 7,414,622 | B2 * | 8/2008 | Abe et al. | 345/204 |
| 7,414,795 | B2 * | 8/2008 | Cok | 359/649 |
| 7,439,941 | B1 | 10/2008 | Kumakura et al. | |
| 7,561,171 | B2 * | 7/2009 | Mori et al. | 345/690 |
| 7,592,981 | B2 * | 9/2009 | Maeda | 345/76 |
| 2003/0011545 | A1 * | 1/2003 | Sagano et al. | 345/76 |
| 2003/0063053 | A1 * | 4/2003 | Yamazaki et al. | 345/82 |
| 2003/0090488 | A1 | 5/2003 | Yoo | |
| 2003/0210256 | A1 | 11/2003 | Mori et al. | |
| 2004/0239580 | A1 * | 12/2004 | Nagatani et al. | 345/1.3 |
| 2004/0251842 | A1 | 12/2004 | Kubota et al. | |
| 2005/0285828 | A1 * | 12/2005 | Inoue et al. | 345/76 |
| 2007/0080905 | A1 * | 4/2007 | Takahara | 345/76 |
| 2007/0103408 | A1 | 5/2007 | Tada et al. | |
| 2007/0200803 | A1 * | 8/2007 | Kimura | 345/76 |
| 2008/0068405 | A1 | 3/2008 | Kumakura et al. | |
| 2008/0136752 | A1 * | 6/2008 | Inoue et al. | 345/77 |
| 2008/0284702 | A1 * | 11/2008 | Shidara et al. | 345/90 |
| 2009/0040148 | A1 | 2/2009 | Kumakura et al. | |

FOREIGN PATENT DOCUMENTS

| | | |
|---|---|---|
| JP | 8 063124 | 3/1996 |
| JP | 11 194745 | 7/1999 |
| JP | 2001 337643 | 12/2001 |
| JP | 2003 280592 | 10/2003 |
| JP | 2005 3749 | 1/2005 |
| JP | 2005 43776 | 2/2005 |
| JP | 2006 195306 | 7/2006 |
| JP | 2006 259287 | 9/2006 |
| JP | 2006 284972 | 10/2006 |

OTHER PUBLICATIONS

European Office Action issued Mar. 19, 2012 in corresponding European Application No. 08 752 808.9.

European Search Report issued Jul. 31, 2012 for Patent Application No. 08 752 808.9-1228.

* cited by examiner

DISPLAY DEVICE, DISPLAY DEVICE DRIVE METHOD, AND COMPUTER PROGRAM

TECHNICAL FIELD

The present invention relates to a display device and a display device drive method, and more particularly, to an active-matrix type display device where scanning lines for selecting pixels in a predetermined scan cycle, data lines providing luminance information for driving the pixels, and pixel circuits for controlling an amount of current based on the luminance information and causing light-emitting elements to emit light according to the amount of current are arranged in a matrix configuration, and a drive method therefore.

BACKGROUND ART

Liquid-crystal display devices that use liquid crystal and plasma display devices that use plasma have found practical application as flat and thin display devices.

A liquid-crystal display device provides a backlight, and displays images by altering an array of liquid-crystal molecules by application of voltage, passing or blocking light from the backlight. Additionally, a plasma display device causes a plasma state to occur by application of voltage to a gas enclosed within a substrate to assume, and ultraviolet light produced by energy occurring on return from the plasma state to the original state becomes visible light through emission to a fluorescent material, displaying an image.

Meanwhile, in recent years, development has been progressing for self-illuminating displays employing organic EL (electroluminescent) elements in which the element itself emits light when voltage is applied. When the organic EL element receives energy by electrolysis, it changes from a ground state to an excited state, and at the time of return from the excited state to the ground state, the energy difference is emitted as light. The organic EL display device is a display device that displays images using the light emitted by these organic EL elements.

A self-illuminating display device, unlike a liquid-crystal display device, which requires a backlight, requires no backlight because the elements themselves emit light, and so it is possible to make the structure thin compared to a liquid-crystal display device. Additionally, because motion characteristics, viewing-angle characteristics, color-reproduction performance, and the like are excellent compared to a liquid-crystal display device, organic EL display devices are attracting attention as next-generation flat and thin display devices.

However, in an organic EL element, light-emission characteristics deteriorate when application of voltage is continued, and luminance declines even with input of the same current. As a result of this, in a case where the light-emission frequency of a specific pixel is high, the light-emission characteristics of the specific pixel deteriorate compared to other pixels, and an image having a disrupted white balance is displayed. The phenomenon in which the light-emission characteristics of a specific pixel deteriorate compared to other pixels is called "burn-in phenomenon."

For example, Patent Document 1 discloses a method for converting luminance of images to retard progression of the degree of deterioration of light-emitting elements of pixel accompanying deterioration of characteristics over time, and prevent deterioration of white balance.

Patent Document 1

Japanese Patent Application Publication No. JP-A-2005-43776

DISCLOSURE OF THE INVENTION

However, the method disclosed in Patent Document 1 has an issue such that signal processing becomes complicated because frequency distribution of gradation is calculated for input images, and thus the images are binarized so that regions on which a fixed image is displayed are calculated.

Accordingly, in light of the foregoing, it is desirable to provide a novel and improved display device which performs signal processing on a video signal having linear characteristic so as to detect presence/non-presence of display of a still image on a screen and adjusts the signal level of a video signal so as to prevent burn-in, and a drive method for the display device and a computer program.

According to an embodiment of the present invention, there is provided a display device which has a display unit in which pixels which have light emitting elements that self-emit light according to an electric current amount and pixel circuits for controlling an electric current applied to the light emitting elements according to video signals, scanning lines which supply selection signals for selecting the pixels that are caused to emit light to the pixels in a predetermined scanning cycle, and data lines which supply the video signals to the pixels are arranged into a matrix pattern. The display device includes: an average value calculation unit which inputs video signals having linear characteristic and calculates an average value of signal levels of the video signals having linear characteristic in each of the pixels; an average value storage unit which sequentially stores the average values calculated by the average value calculation unit; a still image judging unit which judges whether a still image is displayed on a present screen based on a difference between the average value stored in the average value storage unit and a last average value; a coefficient calculation unit which, when it is judged that a still image is displayed on the present screen as a result of the judgment in the still image judging unit, calculates coefficients for reducing luminance of an image displayed on the display unit; and a coefficient multiplying unit which multiplies the video signals by the coefficients calculated by the coefficient calculation unit.

According to this structure, the average value calculation unit inputs video signals having linear characteristic and calculates an average value of signal levels of the video signals having linear characteristic in each of the pixels. The average value storage unit sequentially stores the average values calculated by the average value calculation unit. The still image judging unit judges whether a still image is displayed on a present screen based on a difference between the average value stored in the average value storage unit and a last average value. When it is determined that a still image is displayed on the present screen as a result of the judgment in the still image judging unit, the coefficient calculation unit calculates coefficients for reducing luminance of an image displayed on the display unit. The coefficient multiplying unit multiplies the video signals by the coefficients calculated by the coefficient calculation unit. As a result, by performing signal processing with respect to video signals having linear characteristic and detecting the presence/nonpresence of the display of a still image on the screen, calculating coefficients for adjusting the signal levels of the video signals according to the presence/nonpresence of the display of a still image, and adjusting the signal levels of the video signals, the burn-in phenomenon of the screen can be prevented.

The above-described display device may further include a linear conversion unit which converts video signals having gamma characteristic into the video signals having linear characteristic. According to this structure, the linear conversion unit converts video signals having gamma characteristic into the video signals having linear characteristic. The video signals having linear characteristic converted by the linear conversion unit are input into the average value calculation unit, and the average value of the signal levels is calculated from the video signals. As a result, various types of signal processing with respect to the video signals can be performed easily.

The above-described display device may further include a gamma conversion unit which converts output signals of the coefficient multiplying unit having linear characteristic into signals having gamma characteristic. According to this structure, the gamma conversion unit converts the output signals of the coefficient multiplying unit having linear characteristic into signals having gamma characteristic. As a result, due to the video signals having gamma characteristic, gamma characteristic of the display unit is canceled and linear characteristic can be imparted so that self light emitting elements in the interior of the display unit emit light in response to the signal current.

The still image judging unit may divide the display unit into a plurality of regions, judge whether a still image is displayed on each of the regions, and when judging that the still image is displayed on at least one of the plurality of regions, judge that the still image is displayed on the entire screen.

The coefficient calculation unit may calculate correction coefficients for reducing the luminance in the region where an image having the highest luminance is displayed, or may calculate correction coefficients for reducing the luminance of the entire screen.

The still image judging unit may divide the display unit into a plurality of regions where a number of pixels of one side is an exponentiation of 2. As a result, circuitry to perform signal processing can be simplified.

Additionally, in order to solve the above-described problem, according to another embodiment of the present invention, there is provided a driving method for a display device, the display device having a display unit in which pixels which have light emitting elements that self-emit light according to an electric current amount and pixel circuits for controlling an electric current applied to the light emitting elements according to video signals, scanning lines which supply selection signals for selecting the pixels that are caused to emit light to the pixels in a predetermined scanning cycle, and data lines which supply the video signals to the pixels are arranged into a matrix pattern. The driving method includes the steps of: inputting video signals having linear characteristic and calculating an average value of signal levels of the video signals in each of the pixels; storing the average values calculated at the average value calculating step; judging whether a still image is displayed on the display unit based on a difference between the average value stored at the average value storing step and a last average value; when it is judged that a still image is displayed on the display unit as a result of the judgment at the still image judging step, calculating coefficients for reducing luminance of an image displayed on the display unit; and multiplying the video signals by the coefficients calculated at the coefficient calculating step.

According to this structure, the average value calculating step inputs video signals having linear characteristic and calculates an average value of signal levels of the video signals in each of the pixels. The average value storing step stores the average values calculated at the average value calculating step. The still image judging step judges whether a still image is displayed on the display unit based on a difference between the average value stored at the average value storing step and the last average value. When it is judged that a still image is displayed on the display unit as a result of the judgment at the still image judging step, the coefficient calculating step calculates coefficients for reducing luminance of an image displayed on the display unit. The coefficient multiplying step multiplies the video signals by the coefficients calculated at the coefficient calculating step. As a result, by performing signal processing with respect to video signals having linear characteristic and detecting the presence/nonpresence of the display of a still image on the screen, calculating coefficients for adjusting the signal levels of the video signals according to the presence/nonpresence of the display of a still image, and adjusting the signal levels of the video signals, the burn-in phenomenon of the screen can be prevented.

Additionally, in order to solve the above-described problem, according to another embodiment of the present invention, there is provided a computer program which causes a computer to execute control of a display device having a display unit in which pixels which have light emitting elements that self-emit light according to an electric current amount and pixel circuits for controlling an electric current applied to the light emitting elements according to video signals, scanning lines which supply selection signals for selecting the pixels that are caused to emit light to the pixels in a predetermined scanning cycle, and data lines which supply the video signals to the pixels are arranged into a matrix pattern. The computer program includes the steps of: inputting video signals having linear characteristic and calculating an averages value of signal levels of the video signals in each of the pixels; storing the average values calculated at the average value calculating step; judging whether a still image is displayed on the display unit based on a difference between the average value stored at the average value storing step and a last average value; when it is judged that a still image is displayed on the display unit as a result of the judgment at the still image judging step, calculating coefficients for reducing luminance of an image displayed on the display unit; and multiplying the video signals by the coefficients calculated at the coefficient calculating step.

According to this structure, the average value calculating step inputs video signals having linear characteristic and calculates an average value of signal levels of the video signals in each of the pixels. The average value storing step stores the average values calculated at the average value calculating step. The still image judging step judges whether a still image is displayed on the display unit based on a difference between the average value stored at the average value storing step and the last average value. When it is judged that a still image is displayed on the display unit as a result of the judgment at the still image judging step, the coefficient calculating step calculates coefficients for reducing luminance of an image displayed on the display unit. The coefficient multiplying step multiplies the video signals by the coefficients calculated at the coefficient calculating step. As a result, by performing signal processing with respect to video signals having linear characteristic and detecting the presence/nonpresence of the display of a still image on the screen, calculating coefficients for adjusting the signal levels of the video signals according to the presence/nonpresence of the display of a still image, and adjusting the signal levels of the video signals, the burn-in phenomenon of the screen can be prevented.

According to the present invention described above, there is provided a novel and improved display device which performs signal processing on video signals having linear characteristic and detects the presence/non-presence of the display of a still image on the screen and adjusts the luminance so as to be capable of preventing burn-in, and the drive method for the display device.

EXPLANATION OF NUMERAL

Figure 1:
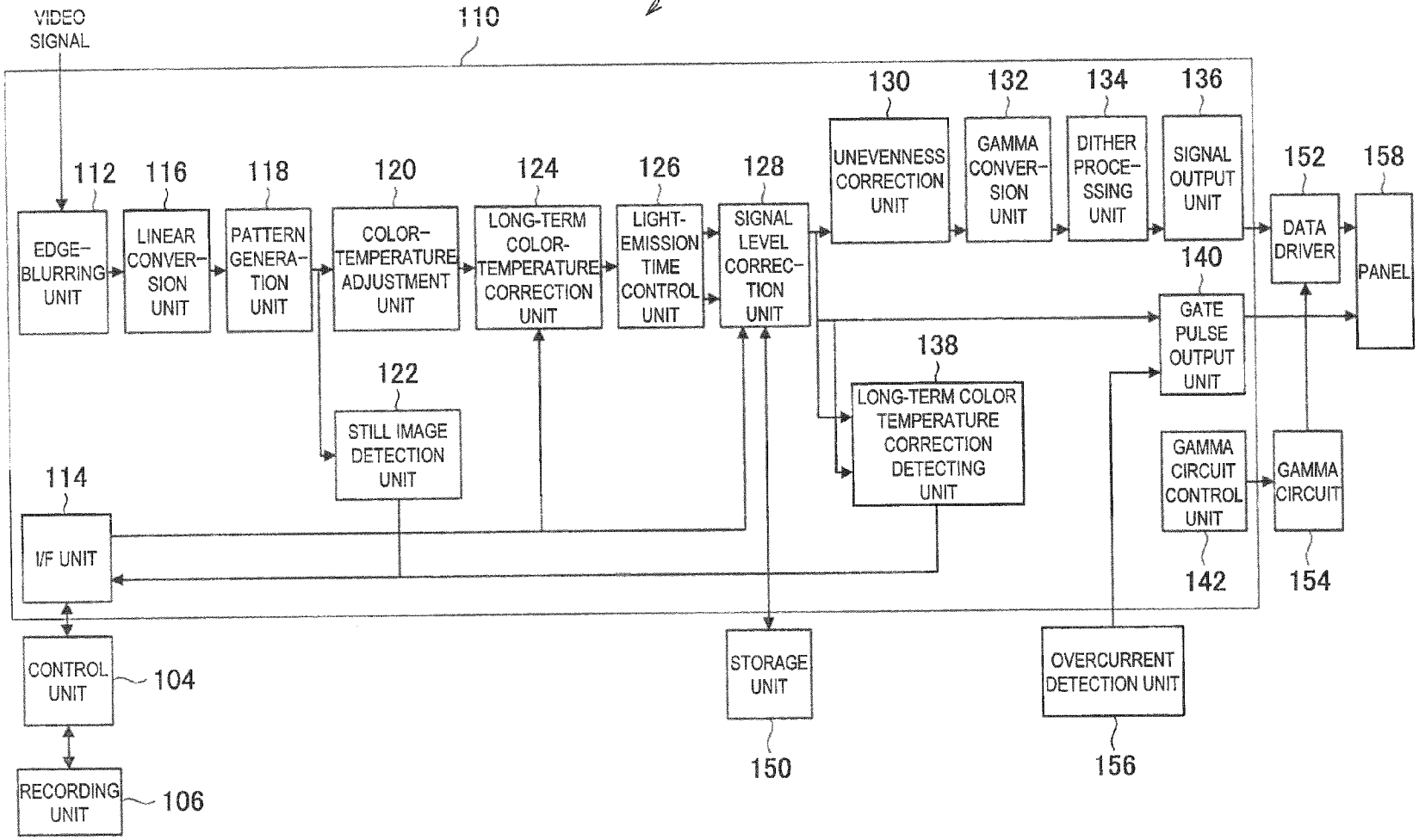
FIG. 1 is an explanatory diagram explaining the structure of a display device 100 according to an embodiment of the present invention.

100 display device
104 control unit
106 recording unit
110 signal-processing integrated circuit
112 edge-blurring unit
114 I/F unit
116 linear conversion unit
118 pattern generation unit
120 color-temperature adjustment unit
122 still image detection unit
124 long-term color-temperature correction unit
126 light-emission time control unit
128 signal level correction unit
130 unevenness correction unit
132 gamma conversion unit
134 dither processing unit
136 signal output unit
138 long-term color-temperature correction detection unit
140 gate pulse output unit

142 gamma-circuit control unit
150 storage unit
152 data driver
154 gamma circuit
156 overcurrent detection unit;
158 panel
162 still image judging unit
164 coefficient calculation unit

BEST MODE FOR CARRYING OUT THE INVENTION

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

Firstly, a structure of a display device according to an embodiment of the present invention will be described. FIG. 1 is an explanatory diagram explaining the structure of a display device 100 according to the embodiment of the present invention. The structure of the display device 100 according to one embodiment of the present invention will be described below with reference to FIG. 1.

As shown in FIG. 1, the display device 100 according to the embodiment of the present invention includes a control unit 104, a recording unit 106, a signal-processing integrated circuit 110, a storage unit 150, a data driver 152, a gamma circuit 154, an overcurrent detection unit 156, and a panel 158.

The signal-processing integrated circuit 110 includes an edge-blurring unit 112, an I/F unit 114, a linear conversion unit 116, a pattern generation unit 118, a color-temperature adjustment unit 120, a still image detection unit 122, a long-term color-temperature correction unit 124, a light-emission time control unit 126, a signal level correction unit 128, an unevenness correction unit 130, a gamma conversion unit 132, a dither processing unit 134, a signal output unit 136, a long-term color-temperature correction detection unit 138, a gate pulse output unit 140, and a gamma-circuit control unit 142.

When receiving a video signal, the display device 100 analyzes the video signal, and turns on pixels arranged in the panel 158, mentioned later, according to the analyzed contents, so as to display a video through the panel 158.

The control unit 104 controls the signal-processing integrated circuit 110 and sends and receives signals to and from the I/F unit 114. Additionally, the control unit 104 executes various signal processing on the signals received from the I/F unit 114. The signal processing executed in the control unit 104 includes, for example, calculation of gain to be used for adjusting luminance of an image displayed on the panel 158.

The recording unit 106 is for storing information for controlling the signal-processing integrated circuit 110 in the control unit 104 therein. A memory that can store information without deletion of the information even if power of the display device 100 is turned off is preferably used as the recording unit 106. An EEPROM (Electronically Erasable and Programmable Read Only Memory) that can electronically rewrite contents is desirably used as the memory that is adopted as the recording unit 106. The EEPROM is a non-volatile memory which can write or delete data with the EEPROM being packaged on a substrate, and is suitable for storing information of the display device 100 that changes moment by moment.

The signal-processing integrated circuit 110 inputs a video signal and executes signal processing with respect to the input video signal. In this embodiment, the video signal input into the signal-processing integrated circuit 110 is a digital signal, and signal width is 10 bits. The signal processing to be executed on the input video signal is executed in the respective units in the signal-processing integrated circuit 110.

The edge-blurring unit 112 executes signal processing for blurring an edge on the input video signal. Specifically, the edge-blurring unit 112 intentionally shifts an image and blurs its edge so as to prevent a phenomenon of burn-in of the image onto the panel 158.

The linear conversion unit 116 executes signal processing for converting a video signal whose output with respect to an input has a gamma characteristic into a video signal having a linear characteristic. When the linear conversion unit 116 executes the signal processing so that the output with respect to the input has the linear characteristic, various processing with respect to images displayed on the panel 158 becomes easy. The signal processing in the linear conversion unit 116 widens the signal width of the video signal from 10 bits to 14 bits.

The pattern generation unit 118 generates test patterns to be used in the image processing inside the display device 100. The test patterns to be used in the image processing in the display device 100 include, for example, a test pattern which is used for display inspection of the panel 158.

The color-temperature adjustment unit 120 adjusts color temperature of images, and adjusts colors to be displayed on the panel 158 of the display device 100. Although not shown in FIG. 1, the display device 100 includes color-temperature adjusting means for adjusting color temperature, and when a user operates the color-temperature adjusting means, color temperature of images to be displayed on the screen can be adjusted manually.

The long-term color-temperature correction unit 124 corrects deterioration with age due to variation in luminance/time characteristic (LT characteristic) of respective colors R (red), G (green), and B (blue) of organic EL elements. Because the organic EL elements have different LT characteristics of R, G, and B, color balance deteriorates over light-emission time. The long-term color-temperature correction unit 124 corrects the color balance.

The light-emission time control unit 126 calculates a duty ratio of a pulse at the time of displaying video on the panel 158, and controls the light-emission time of the organic EL elements. The display device 100 applies an electric current to the organic EL elements in the panel 158 while the pulse is in a HI state, so as to cause the organic EL elements to emit light and display an image.

The signal level correction unit 128 corrects the level of the video signal and adjusts the luminance of the video to be displayed on the panel 158 in order to prevent an image burn-in phenomenon. In the image burn-in phenomenon, deterioration of light-emission characteristics occurs in a case where the light-emission frequency of a specific pixel is high compared to other pixels, leading to a decline in luminance of the pixel that has deteriorated compared with other pixels which have not deteriorated, and the difference in luminance with the surrounding portion which has not deteriorated becomes larger. Due to this difference in luminance, text appears to be burned into the screen.

The signal level correction unit 128 calculates the amount of light emission of respective pixels or a pixel group based on the video signal and the duty ratio of the pulse calculated by the light-emission time control unit 126, and calculates gain for reducing the luminance according to need based on the calculated amount of light emission, so as to multiply the video signal by the calculated gain.

The long-term color-temperature correction detection unit 138 detects information for correction in the long-term-temperature correction unit 124. The information detected by the long-term color-temperature correction detection unit 138 is sent to the control unit 104 via the I/F unit 114, and is recorded in the recording unit 106 via the control unit 104.

The unevenness correction unit 130 corrects unevenness of images and videos displayed on the panel 158. Horizontal stripes and vertical stripes of the panel 158 and unevenness of the entire screen are corrected based on the level of an input signal and a coordinate position.

The gamma conversion unit 132 executes signal processing for converting the video signal converted into a signal having a linear characteristic by the linear conversion unit 116 into a signal having a gamma characteristic. The signal processing executed in the gamma conversion unit 132 is signal processing for canceling the gamma characteristic of the panel 158 and converting a signal into a signal having a linear characteristic so that the organic EL elements in the panel 158 emit light according to the electric current of the signal. When the gamma conversion unit 132 performs the signal processing, the signal width changes from 14 bits to 12 bits.

The dither processing unit 134 executes dithering with respect to the signal converted by the gamma conversion unit 132. The dithering provides display where displayable colors are combined in order to express medium colors in an environment in which the number of usable colors is small. By executing dithering by the dither processing unit 134, colors which intrinsically cannot be displayed on the panel can be simulated and expressed. The signal width is changed from 12 bits to 10 bits by the dithering in the dither processing unit 134.

The signal output unit 136 outputs the signal after dithering by the dither processing unit 134 to the data driver 152. The signal sent from the signal output unit 136 to the data driver 152 is a signal multiplied by information about the amount of light emission of respective colors R, G, and B, and the signal multiplied by the information about the light-emission time is output in the form of a pulse from the gate pulse output unit 140.

The gate pulse output unit 140 outputs a pulse for controlling the light-emission time of the panel 158. The pulse output from the gate pulse output unit 140 is a pulse calculated by the light-emission time control unit 126 based on the duty ratio. The pulse from the gate pulse output unit 140 determines the light-emission time of each pixel on the panel 158.

The gamma-circuit control unit 142 gives a setting value to the gamma circuit 154. The setting value is a reference voltage to be given to ladder resistance of a D/A converter contained inside the data driver 152.

The storage unit 150 stores information that becomes necessary when a signal level is corrected in the signal level correction unit 128. Unlike the recording unit 106, a memory in which contents are deleted when the power is turned off may be used as the storage unit 150, and, for example, SDRAM (Synchronous Dynamic Random Access Memory) is desirably used as such a memory. The information to be stored in the storage unit 150 is described later.

In a case where overcurrent is produced by substrate short circuit or the like, the overcurrent detection unit 156 detects the overcurrent and notifies the gate pulse output unit 140. In a case where overcurrent is produced, the overcurrent detection unit 156 can prevent the overcurrent from being applied to the panel 158.

The data driver 152 executes signal processing with respect to the signal received from the signal output unit 136, and outputs a signal for displaying video on the panel 158 to the panel 158. The data driver 152 includes a D/A converter, and converts a digital signal into an analog signal and outputs the analog signal.

The gamma circuit 154 gives a reference voltage to the ladder resistance of the D/A converter contained inside the data driver 152. The reference voltage to be given to the ladder resistance is generated by the gamma-circuit control unit 142.

The panel 158 is one example of a display unit of the present invention, and inputs an output signal from the data driver 152 and an output pulse from the gate pulse output unit 140, causing the organic EL elements to emit light to display an image according to the input signal and pulse. The organic EL elements are self-illuminating type elements which emit light when a voltage is applied, and their amount of light emission is proportional to the voltage. Consequently, an IL characteristic (current/light-emission amount characteristic) of the organic EL elements also comes to have a proportional relationship.

In the panel 158, not shown in the figure, scanning lines that select pixels in a predetermined scanning cycle, data lines that give luminance information for driving the pixels, and pixel circuits that control the amount of electric current based on the luminance information and cause the organic EL elements as light emitting elements to emit light according to the amount of electric current, are structured by arrangement in a matrix pattern, and the structuring of the scanning lines, the data lines, and the pixel circuits in this way enables the display device 100 to display images.

The structure of the display device 100 according to the embodiment of the present invention has been described above with reference to FIG. 1. The display device 100 according to the embodiment of the present invention depicted in FIG. 1 converts a video signal to a signal having a linear characteristic using the linear conversion unit 116 and thereafter inputs the converted video signal into the pattern generation unit 118, but the pattern generation unit 118 and the linear conversion unit 116 may be interchanged.

Next, a characteristic transition of a signal flowing in the display device 100 according to the embodiment of the present invention will be described below. FIGS. 2A through 2F are explanatory diagrams explaining, using graphs, characteristic transitions of the signal flowing in the display device 100 according to the embodiment of the present invention. In the respective graphs in FIGS. 2A to 2F, an abscissa axis represents input and an ordinate axis represents output.

Figure 2A:
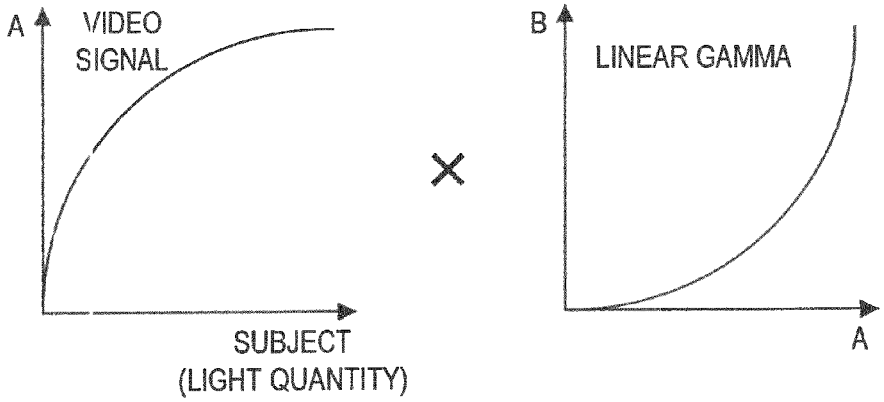
FIG. 2A is an explanatory diagram explaining, using a graph, a characteristic transition of a signal flowing in the display device 100 according to the embodiment of the present invention.

FIG. 2A illustrates that when a subject is input, the linear conversion unit 116 multiplies a video signal whose output A with respect to the light quantity of the subject has a gamma characteristic by an inverse gamma curve (linear gamma) so as to convert the video signal into a video signal whose output with respect to the light quantity of the subject has a linear characteristic.

Figure 2B:
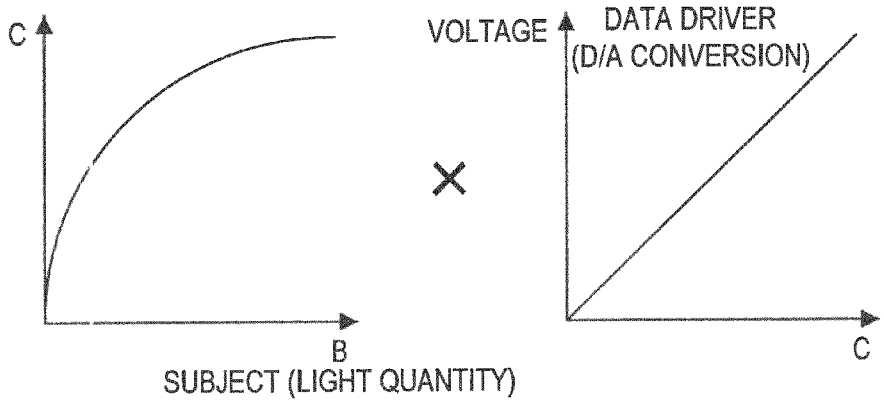
FIG. 2B is an explanatory diagram explaining, using a graph, a characteristic transition of the signal flowing in the display device 100 according to the embodiment of the present invention.

FIG. 2B illustrates that the gamma conversion unit 132 multiplies a video signal converted so that an output B with respect to the input of the light quantity of the subject has a linear characteristic by a gamma curve, so as to convert the video signal into a video signal whose output with respect to the input of the light quantity of the subject has a gamma characteristic.

Figure 2C:
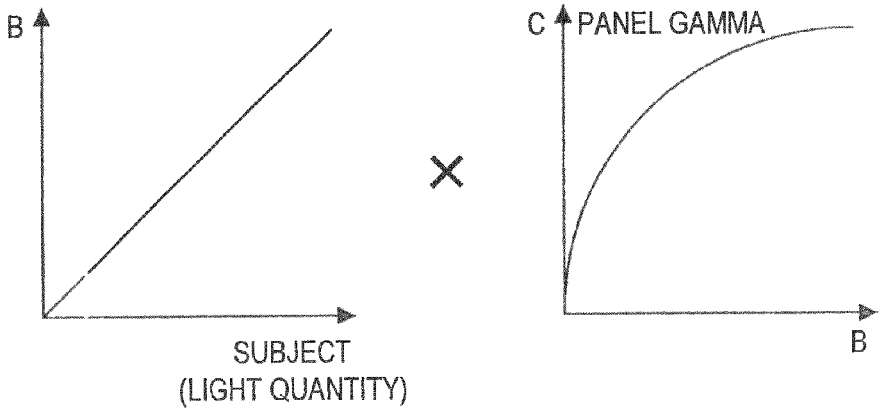
FIG. 2C is an explanatory diagram explaining, using a graph, a characteristic transition of the signal flowing in the display device 100 according to the embodiment of the present invention.

FIG. 2C illustrates that the data driver 152 performs D/A conversion of a video signal, which is converted so that an output C with respect to the input of the light quantity of the subject has the gamma characteristic, into an analog signal. In the D/A conversion, a relationship between input and output has the linear characteristic. Consequently, the data driver 152 performs D/A conversion on a video signal, and when the light quantity of the subject is input, an output voltage has the gamma characteristic.

Figure 2D:
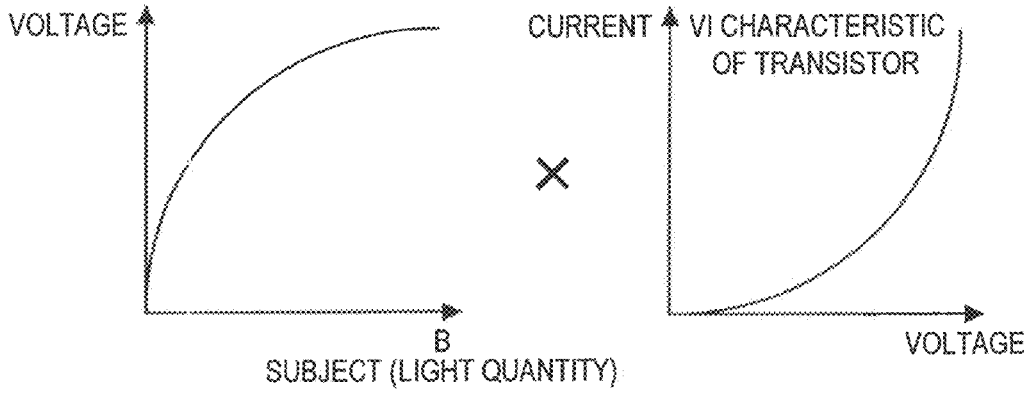
FIG. 2D is an explanatory diagram explaining, using a graph, a characteristic transition of the signal flowing in the display device 100 according to the embodiment of the present invention.

FIG. 2D illustrates that when the video signal which was subject to the D/A conversion is input into a transistor included in the panel 158, both gamma characteristics are canceled. The VI characteristic of the transistor is the gamma characteristic which has a curve inverse to a gamma characteristic of the output voltage with respect to the input of the light quantity of the subject. Consequently, when the light quantity of the subject is input, the conversion can be again carried out so that the output current has a linear characteristic.

Figure 2E:
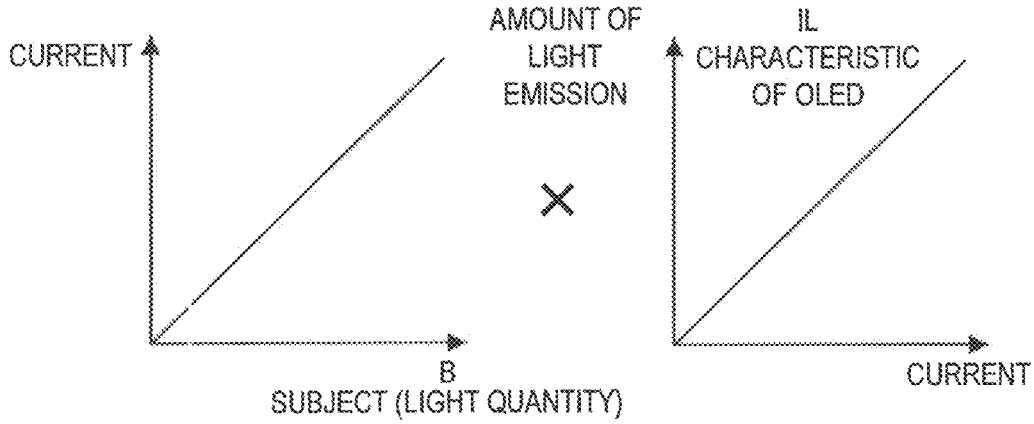
FIG. 2E is an explanatory diagram explaining, using a graph, a characteristic transition of the signal flowing in the display device 100 according to the embodiment of the present invention.

FIG. 2E illustrates that when the light quantity of the subject is input, the signal whose output current has a linear characteristic is input into the panel 158, and the signal having the linear characteristic is multiplied by the IL characteristic of the organic EL elements having the linear characteristic.

Figure 2F:
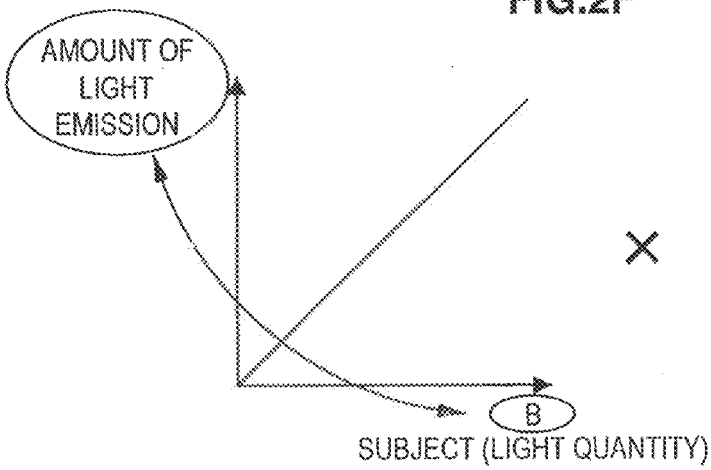
FIG. 2F is an explanatory diagram explaining, using a graph, a characteristic transition of the signal flowing in the display device 100 according to the embodiment of the present invention.

As a result, as shown in FIG. 2F, when the light quantity of the subject is input, the amount of light emission of the panel (OLED; Organic Light Emitting Diode) has the linear characteristic. Therefore, by multiplying the video signal by an inverse gamma curve and converting the video signal in the linear conversion unit 116 so as to have a linear characteristic, it becomes possible to perform signal processing on the interval to the gamma conversion unit 132 from the linear conversion unit 116 in the signal-processing integrated circuit 110 shown in FIG. 1 as a linear region.

The characteristic transitions of the signals flowing in the display device 100 according to the embodiment of the present invention have been described above.

[Pixel Circuit Structure]

Next, one example of the structure of the pixel circuit disposed in the panel 158 will be described.

Figure 3:
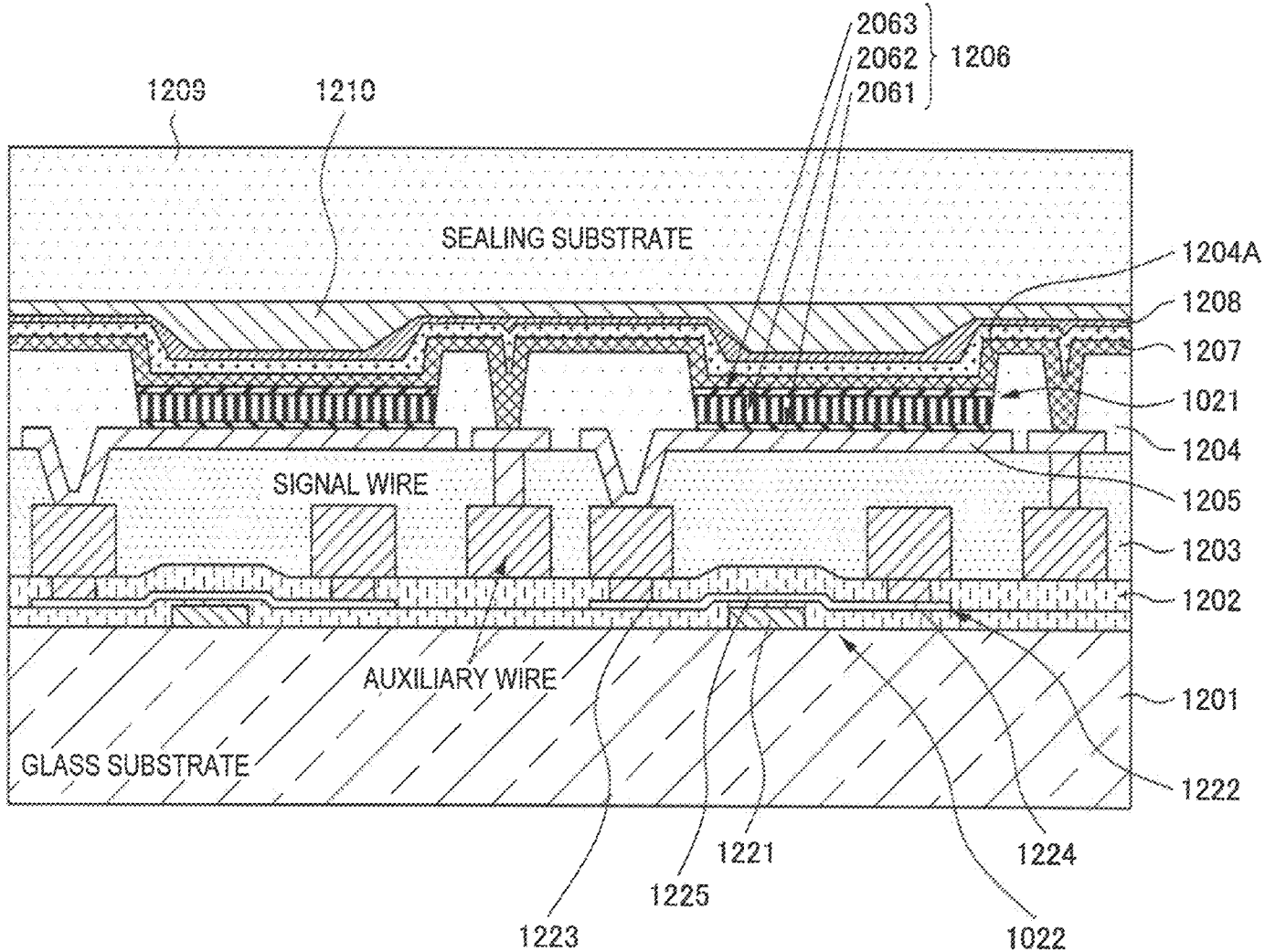
FIG. 3 is a cross-sectional view depicting one example of cross-sectional structure of a pixel circuit disposed in a panel 158.

FIG. 3 is a cross-sectional view depicting one example of cross-sectional structure of the pixel circuit disposed in the panel 158. As shown in FIG. 3, the pixel circuit disposed in the panel 158 has a structure in which an insulation film 1202, an insulation leveling film 1203, and a window insulation film 1204 are formed in that order on a glass substrate 1201 in which is formed a drive circuit including a drive transistor 1022 and the like, and an organic EL element 1021 disposed in a concavity 1204A in the window insulation film 1204. Here, of the respective structural elements of the drive circuit, only the drive transistor 1022 is depicted, and indication of other structural elements is omitted.

The organic EL element 1021 is made up of an anode electrode 1205 composed of metal or the like formed on a bottom portion of the concavity 1204A in the window insulation film 1204, an organic layer (electron-transport layer, light-emission layer, and hole-transport layer/hole-implantation layer) 1206 formed on the anode electrode 1205, and a cathode electrode 1207 made up of a transparent conductive film or the like formed commonly on all pixels on the organic layer 1206.

In this organic EL element 1021, the organic layer 1206 is formed by sequentially depositing a hole-transport layer/hole-implantation layer 2061, a light-emission layer 2062, an electron-transport layer 2063, and an electron-implantation layer (not shown in the figure) on the anode electrode 1205. Accordingly, light is emitted when electrons and holes recombine in the light-emission layer 2062 in the organic layer 1206 due to current flowing from the drive transistor 1022 via the anode electrode 1205 to the organic layer 1206, under current drive by the drive transistor 1022.

The drive transistor 1022 is made up of a gate electrode 1221, a source/drain region 1223 disposed on one side of a semiconductor layer 1222, a drain/source region 1224 disposed on the other side of the semiconductor layer 1222, and a channel-forming region 1225 of a portion facing the gate electrode 1221 of the semiconductor layer 1222. The source/drain region 1223 is electrically connected to the anode electrode 1205 of the organic EL element 1021 via a contact hole.

Accordingly, as shown in FIG. 3, after the organic EL element 1021 has been formed in pixel units, via the insulation film 1202, the insulation leveling film 1203, and the window insulation film 1204, on the glass substrate 1201 in which is formed the drive circuit including the drive transistor 1022, a sealing substrate 1209 is attached by an adhesive 1210 via a passivation film 1208, and the organic EL element 1021 is sealed by the sealing substrate 1209, forming the panel 158.

[Drive Circuit]

Next, one example of the structure of the drive circuit disposed in the panel 158 will be described.

Various circuits exist as drive circuits for driving a light-emission unit ELP provided with organic EL elements, but items common to a drive circuit fundamentally made up of five transistors/one capacitor (which hereinafter may in some cases be called a 5Tr/1C drive circuit), a drive circuit fundamentally made up of four transistors/one capacitor (which hereinafter may in some cases be called a 4Tr/1C drive circuit), a drive circuit fundamentally made up of three transistors/one capacitor (which hereinafter may in some cases be called a 3Tr/1C drive circuit), and a drive circuit fundamentally made up of two transistors/one capacitor (which hereinafter may in some cases be called a 2Tr/1C drive circuit) will firstly be explained below.

For convenience, each transistor constituting a drive circuit is, in principle, described as being made up of an n-channel type thin-film transistor (TFT). Note, however, that depending on the case, a portion of the transistors can also be made up of p-channel type TFTs. Note that a structure in which transistors are formed on a semiconductor substrate or the like can also be used. The structure of the transistors constituting the drive circuit is not particularly limited. In the explanation below, transistors constituting a drive circuit are described as being of enhancement type, but are not limited to this. Depression type transistors may be used. Additionally, transistors constituting the drive circuit may be of single-gate type, or may be of dual-gate type.

In the explanation below, a display device is made up of (N/3)×M pixels arranged in a two-dimensional matrix pattern, and one pixel is taken to be made up of three sub-pixels (a red light-emitting sub-pixel that emits red light, a green light-emitting sub-pixel that emits green light, and a blue light-emitting sub-pixel that emits blue light). Additionally, the light-emitting elements constituting each pixel are taken to be driven in line sequence, and a display frame rate is taken to be FR (times/second). That is to say, (N/3) pixels arranged in an mth row (where m=1, 2, 3, . . . M), or more specifically, light-emitting elements respectively made up of N sub-pixels, are driven simultaneously. To state this differently, in respective light-emitting elements constituting one row, timing of their light emission/light nonemission is controlled by the unit of the row to which they belong. Note that processing for writing a video signal with regard to respective pixels making up one row may be processing to write a video signal for all pixels simultaneously (which hereinafter may in some cases be called simply simultaneous write processing), or may be processing to write a sequential video signal for each pixel (which hereinafter may in some cases be called simply sequential write processing). Which write processing is used may be arbitrarily selected according to the structure of the drive circuit.

Here, in principle, drive and operation relating to a light-emitting element positioned at an mth row and nth column (where n=1, 2, 3, . . . N) are described, but such a light-emitting element refers, hereinafter, to an (n, m)th light-emitting element or an (n, m)th sub-pixel. Accordingly, various processing (threshold-voltage cancel processing, write processing, and mobility-correction processing, described later) is performed until a horizontal scanning period of respective pixels arranged in the mth row (mth horizontal scanning period) ends. Note that performing write processing and mobility-correction processing within the mth horizontal scanning period is necessary. On the other hand, depending on the type of the drive circuit, threshold-voltage cancel processing and preprocessing accompanying this can be performed in advance of the mth horizontal scanning period.

Accordingly, after the various processing described above has finished completely, light-emission units constituting the respective light-emitting elements arranged in the mth row are caused to emit light. Note that after the various processing described above has finished completely, the light-emission units may be caused to emit light immediately, or the light-emission units may be caused to emit light after a predetermined period (for example, a predetermined horizontal scanning period for several rows) has elapsed. This predetermined period can be set suitably according to a specification of the display device or structure or the like of the drive circuit. Note that, in the explanation below, for convenience of explanation, the light-emission unit is taken to be caused to emit light immediately after the various types of processing finish. Accordingly, light emission of the light-emission units constituting the respective light-emitting elements arranged in the mth row is continued until just before the start of a horizontal scanning period of respective light-emitting elements arranged in an (m+m')th row. Here, "m'" is determined according to a design specification of the display device. That is to say, light emission of light-emission units constituting respective light-emitting elements arranged in an mth row in a given display frame is continued until an (m+m'−1)th horizontal scanning period. On the other hand, light-emission units constituting respective light-emitting elements arranged in the mth row are in principle maintained in a light-nonemission state from a start period of an (m+m')th horizontal scanning period until write processing and mobility-correction processing within an mth horizontal scanning period in the subsequent display frame are completed. By establishing a period of the above-described light-nonemission state (which hereinafter may in some cases be called simply a light-nonemission period), afterimage blur accompanying active-matrix drive is reduced, and moving-image quality can be made more excellent. Note, however, that the light-emission/light-nonemission state of respective sub-pixels (light-emitting elements) is not limited to the state described above. Additionally, the time length of the horizontal scanning period is a time length of less than (1/FR)×(1/M) seconds. In a case where the value of (m+m') exceeds M, the horizontal scanning period of the exceeding amount is processed in the next display frame.

In two source/drain regions having one transistor, the term "source/drain region of one side" may in some cases be used with the meaning of a source/drain region on a side connected to an electric power-source unit. Additionally, a transistor being in an "on" state signifies a state in which a channel has been formed between source/drain regions. Whether or not current flows from the source/drain region of one side of the transistor to the source/drain region of the other side is immaterial. On the other hand, a transistor being in an "off" state signifies a state in which a channel has not been formed between source/drain regions. Additionally, a source/drain region of a given transistor being connected to a source/drain region of another transistor includes a mode in which the source/drain region of the given transistor and the source/drain region of the other transistor occupy the same region. Further, a source/drain region can be constituted not only by an electrically conductive material such as impurity-containing polysilicon or amorphous silicon or the like, but can be constituted by a metal, an alloy, electrically conductive particles, a layered structure of these, or layers made up of an organic material (an electrically conductive polymer). Additionally, in timing charts used in the explanation below, length (time length) of a horizontal axis indicating each period is schematic, and does not indicate a proportion of time length of each period.

Figure 4:
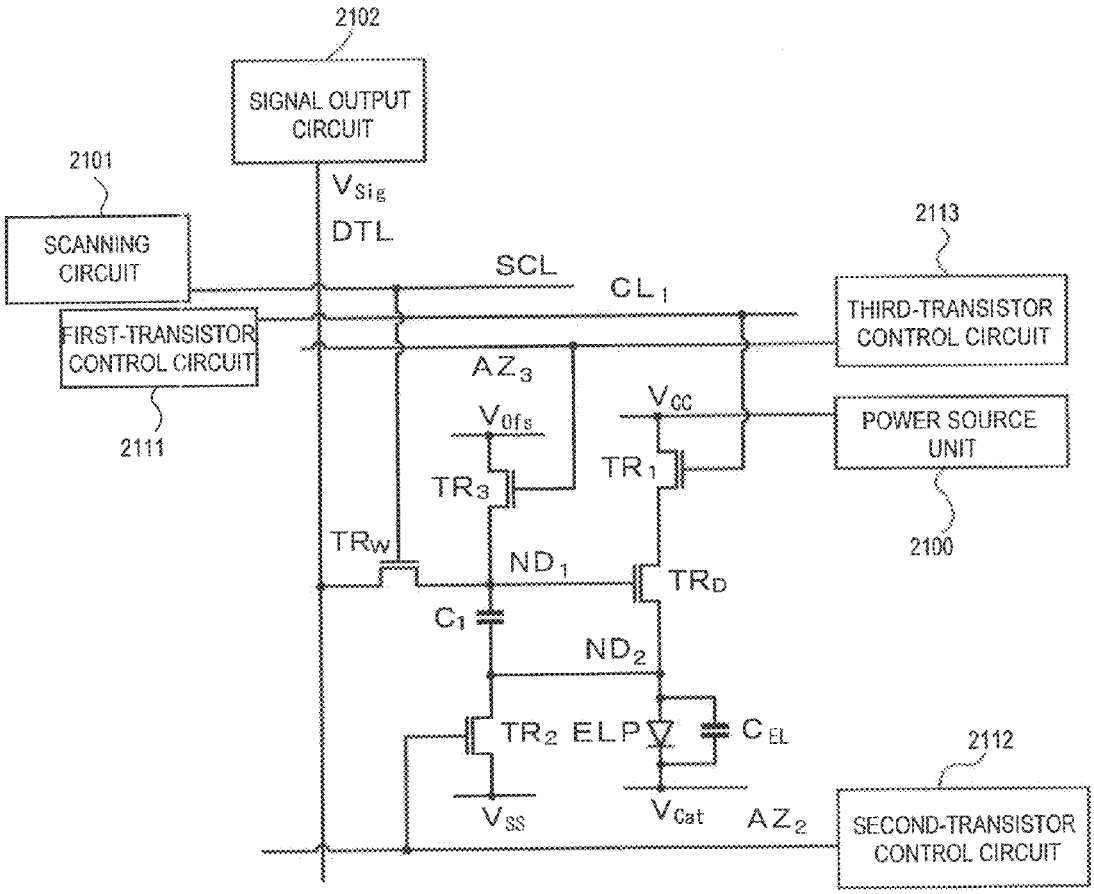
FIG. 4 is an equivalent circuit diagram of a 5Tr/1C drive circuit.

A drive method of a light-emission unit ELP employed in a drive circuit indicated in FIG. 4 or the like is made up of steps of, for example:

(a) performing preprocessing to apply a first-node initialization voltage to a first node $ND_1$ and to apply a second-node $ND_2$ initialization voltage to a second node $ND_2$ so that an electric potential difference between the first node $ND_1$ and the second node $ND_2$ exceeds a threshold voltage of a drive transistor $TR_D$, and moreover an electric potential difference between the second node $ND_2$ and a cathode electrode disposed on the light-emission unit ELP does not exceed a threshold voltage of the light-emission unit ELP, and subsequently, (b) performing, in a state where the electric potential of the first node $ND_1$ is maintained, threshold-voltage cancel processing to change the electric potential of the second node $ND_2$ toward an electric potential at which the threshold voltage of the drive transistor $TR_D$ is reduced from the electric potential of the first node $ND_1$, and thereafter, (c) performing write processing to apply a video signal from a data line DTL to the first node $ND_1$ via a write transistor $TR_W$ switched to an "on" state by a signal from a scanning line SCL, and subsequently, (d) driving the light-emission unit ELP by putting the first node $ND_1$ in a floating state by switching the write transistor $TR_W$ to an "off" state by the signal from the scanning line SCL, and causing current to flow to the light-emission unit ELP from a power source unit 2100 via the drive transistor $TR_D$ according to the value of an electric potential difference between the first node $ND_1$ and the second node $ND_2$.

As was described above, the step (b) performs, in a state where the electric potential of the first node $ND_1$ is maintained, threshold-voltage cancel processing to change the electric potential of the second node $ND_2$ toward an electric potential at which the threshold voltage of the drive transistor $TR_D$ is reduced from the electric potential of the first node $ND_1$. More specifically, to change the electric potential of the second node $ND_2$ toward the electric potential at which the threshold voltage of the drive transistor $TR_D$ is reduced from the electric potential of the first node $ND_1$, voltage exceeding a voltage which is the threshold voltage of the drive transistor $TR_D$ added to the electric potential of the second node $ND_2$ in the step (a) is applied to the source/drain region of one side of the drive transistor $TR_D$. Qualitatively, in the threshold-voltage cancel processing, the extent at which the electric potential difference between the first node $ND_1$ and the second node $ND_2$ (stated differently, the electric potential difference between the gate electrode and the source region of the drive transistor $TR_D$) approaches the threshold voltage of the drive transistor $TR_D$ is affected by the time of the threshold-voltage cancel processing. Consequently, in a mode in which, for example, a sufficiently long time of the threshold-voltage cancel processing is established, the electric potential of the second node $ND_2$ reaches an electric potential at which the threshold voltage of the drive transistor $TR_D$ is reduced from the electric potential of the first node $ND_1$. Accordingly, the electric potential difference between the first node $ND_1$ and the second node $ND_2$ reaches the threshold voltage of the drive transistor $TR_D$, and the drive transistor $TR_D$ changes to an "off" state. On the other hand, in a mode in which, for example, the time of the threshold-voltage cancel processing is established must unavoidably be set short, a case may occur in which the electric potential difference between the first node $ND_1$ and the second node $ND_2$ becomes larger than the threshold voltage of the drive transistor $TR_D$, and the drive transistor $TR_D$ does not change to an "off" state. The drive transistor $TR_D$ need not necessarily change to an "off" state as a result of the threshold-voltage cancel processing.

Next, the drive-circuit structure of each respective drive circuit and a drive method of the light-emission unit ELP that uses these drive circuits will be explained in detail hereinafter.

[5Tr/1C Drive Circuit]

Figure 5:
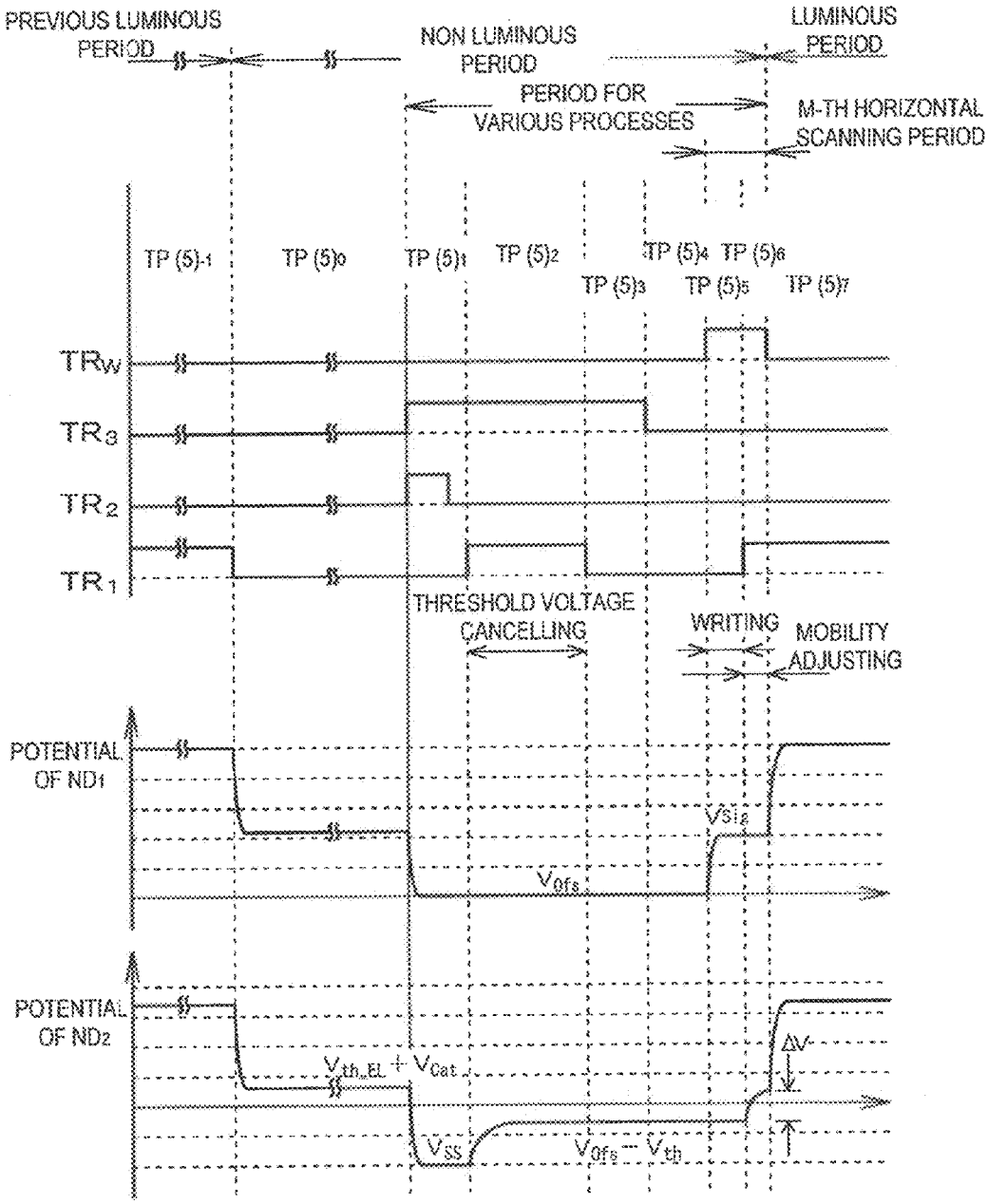
FIG. 5 is a timing chart of drive of the 5Tr/1C drive circuit.

An equivalent circuit diagram of a 5Tr/1C drive circuit is depicted in FIG. 4, a timing chart of drive of the 5Tr/1C drive circuit illustrated in FIG. 4 is depicted schematically in FIG. 5, and on/off states and the like of each transistor of the 5Tr/1C drive circuit are depicted schematically in FIG. 6A through FIG. 6I.

This 5Tr/1C drive circuit is constituted by five transistors: a write transistor $TR_W$, a drive transistor $TR_D$, a first transistor $TR_1$, a second transistor $TR_2$, and a third transistor $TR_3$. It is further constituted by a capacitor $C_1$. Note that the write transistor $TR_W$, the first transistor $TR_1$, the second transistor $TR_2$, and the third transistor $TR_3$ may be constituted by a p-channel type TFT.

[First Transistor $TR_1$]

A source/drain region of one side of the first transistor $TR_1$ is connected to the power source unit 2100 (voltage $V_{CC}$), and a source/drain region of another side of the first transistor $TR_1$ is connected to a source/drain region of one side of the drive transistor $TR_D$. Additionally, on/off operation of the first transistor $TR_1$ is controlled by a first-transistor control line $CL_1$ extending from a first-transistor control circuit 2111 and connected to a gate electrode of the first transistor $TR_1$. The power source unit 2100 is provided to supply current to the light-emission unit ELP and cause the light-emission unit ELP to emit light.

[Drive Transistor $TR_D$]

The source/drain region of the one side the drive transistor $TR_D$, as was described above, is connected to the source/drain region of the other side of the first transistor $TR_1$. On the other hand, the source/drain region of the other side of the drive transistor $TR_D$ is connected to:

(1) an anode electrode of the light-emission unit ELP,
(2) a source/drain region of another side of the second transistor $TR_2$, and
(3) one electrode of the capacitor $C_1$, and makes up the second node $ND_2$. Additionally, the gate electrode of the drive transistor $TR_D$ is connected to:
(1) a source/drain region of another side of the write transistor $TR_W$,
(2) a source/drain region of another side of the third transistor $TR_3$, and
(3) another electrode of the capacitor $C_1$, and makes up the first node $ND_1$.

Here, the drive transistor $TR_D$, in a light-emission state of a light-emitting element, is driven according to equation (1) hereinafter so as to cause a drain current $I_{ds}$ to flow. In the light-emission state of the light-emitting element, the source/drain region on the one side of the drive transistor $TR_D$ functions as a drain region, and the source/drain region of the other side functions as a source region. For convenience of explanation, in the explanation hereinafter, in some cases the source/drain region of the one side of the drive transistor $TR_D$ may be called simply the drain region, and the source/drain region of the other side may be called the source region. Note that:

μ: effective mobility
L: channel length
W: channel width
$V_{gs}$: electric potential difference between gate electrode and source region
$V_{th}$: threshold voltage
$C_{ox}$: (relative permittivity of gate insulation layer)×(electric constant)/(thickness of gate insulation layer)

$$k \equiv (1/2)\cdot(W/L)\cdot C_{ox}$$

is taken to hold.

$$I_{ds} = k\cdot\mu\cdot(V_{gs} - V_{th})^2 \quad (1)$$

The light emission unit ELP emits light due to this drain current $I_{ds}$ flowing through the light emission unit ELP. The light emission state (luminance) of the light emission unit ELP is controlled by the size of the value of this drain current

[Write Transistor $TR_W$]

The source/drain region of the other side of the write transistor $TR_W$, as was described above, is connected to the gate electrode of the drive transistor $TR_D$. On the other hand, a source/drain region of one side of the write transistor $TR_W$ is connected to a data line DTL extending from a signal output circuit 2102. Accordingly, a video signal $V_{Sig}$ for controlling luminance at the light emission unit ELP is supplied to the source/drain region of one side via the data line DTL. Note that various signals or voltages (signals or various reference voltages or the like for precharge drive) other than $V_{Sig}$ may be supplied to the source/drain region of one side via the data line DTL. Additionally, on/off operation of the write transistor $TR_W$ is controlled by a scanning line SCL extending from a scanning circuit 2101 and connected to the gate electrode of the write transistor $TR_W$.

[Second Transistor $TR_2$]

The source/drain region of the other side of the second transistor $TR_2$, as was described above, is connected to the source region of the drive transistor $TR_D$. On the other hand, voltage $V_{SS}$ for initializing the electric potential of the second node $ND_2$ (that is to say, the electric potential of the source region of the drive transistor $TR_D$) is supplied to the source/drain region of one side of the second transistor $TR_2$. Additionally, on/off operation of the second transistor $TR_2$ is controlled by a second transistor control line $AZ_2$ extending from a second-transistor control circuit 2112 and connected to the gate electrode of the second transistor $TR_2$.

[Third Transistor $TR_3$]

The source/drain region of the other side of the third transistor $TR_3$, as was described above, is connected to the gate electrode of the drive transistor $TR_D$. On the other hand, voltage $V_{0fs}$ for initializing the electric potential of the first node $ND_1$ (that is to say, the electric potential of the gate electrode of the drive transistor $TR_D$) is supplied to the source/drain region of one side of the third transistor $TR_3$. Additionally, on/off operation of the third transistor $TR_3$ is controlled by a third transistor control line $AZ_3$ extending from a third-transistor control circuit 2113 and connected to the gate electrode of the third transistor $TR_3$.

[Light Emission Unit ELP]

The anode electrode of the light emission unit ELP, as was described above, is connected to the source region of the drive transistor $TR_D$. On the other hand, voltage $V_{Cat}$ is applied to the cathode electrode of the light emission unit ELP. Capacitance of the light emission unit ELP is indicated by a symbol $C_{EL}$. Additionally, threshold voltage taken to be necessary for light emission of the light emission unit ELP is taken to be $V_{th\text{-}EL}$. That is to say, when voltage of $V_{th\text{-}EL}$ or more is applied between the anode electrode and the cathode electrode of the light emission unit ELP, the light emission unit ELP emits light.

In the explanation hereinafter, values of voltage or electric potential are as shown below, but these are only values for explanation, and there is no limitation to these values.

$V_{Sig}$: video signal for controlling luminance at the light emission unit ELP . . . 0 volts to 10 volts $V_{CC}$: voltage of the electric power source unit 2100 . . . 20 volts $V_{0fs}$: voltage for initializing the electric potential of the gate electrode of the drive transistor $TR_D$ (the electric potential of the first node $ND_1$) . . . 0 volts $V_{SS}$: voltage for initializing the electric potential of the source region of the drive transistor $TR_D$ (the electric potential of the second node $ND_2$) . . . −10 volts $V_{th}$: threshold voltage of the drive transistor $TR_D$ . . . 3 volts $V_{Cat}$: voltage applied to the cathode electrode of the light emission unit ELP . . . 0 volts $V_{th\text{-}EL}$: threshold voltage of the light emission unit ELP . . . 3 volts Operation of the 5Tr/1C drive circuit will be described hereinafter. Note that, as was described above, it is described that a light emission state is taken to begin immediately after the various types of processing (threshold voltage cancel processing, write processing, and mobility correction processing) have finished, but there exists no limitation to this. This is similar for the 4Tr/1C drive circuit, 3Tr/1C drive circuit, and 2Tr/1C drive circuit that will be described later.

Figure 6A:
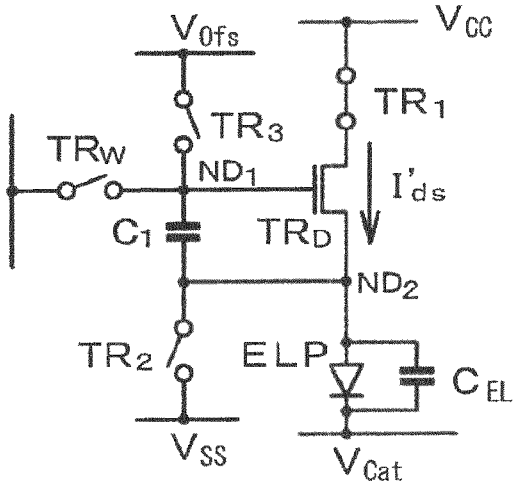
FIG. 6A is an explanatory diagram depicting on/off states and the like of each transistor of the 5Tr/1C drive circuit.

[Period—TP $(5)_{-1}$] (Refer to FIG. 5 and FIG. 6A)

This [period—TP $(5)_{-1}$] is for example operation in a previous display frame, and is a period in which the (n, m)th light emitting elements after completion of the previous various types of processing are in the light emission state. That is to say, drain current $I'_{ds}$ flows to the light emission unit ELP in the light emitting elements making up the (n, m)th sub-pixels on a basis of equation (5) described later, and luminance of the light emitting elements making up the (n, m)th sub-pixels is a value corresponding to the drain current $I'_{ds}$. Here, the write transistor $TR_W$, the second transistor $TR_2$, and the third transistor $TR_3$ are in an "off" state, and the first transistor $TR_1$ and the drive transistor $TR_D$ are in an "on" state. The light emission state of the (n, m)th light emitting elements is continued until immediately before the start of the horizontal scanning period of the light emitting elements arranged in the (m+m')th row.

[Period—TP $(5)_0$] through [period—TP $(5)_4$] depicted in FIG. 5 are an operation period from after the light emission state after completion of the previous various types of processing until immediately before the next write processing is performed. That is to say, this [period—TP $(5)_0$] through [period—TP $(5)_4$] is a period of a given time length, for example, from the start period of the (m+m')th horizontal scanning period in the previous display frame until the end period of the (m−1)th horizontal scanning period. Note that [period—TP $(5)_1$] through [period—TP $(5)_4$] can be taken to be included in the mth horizontal scanning period in the present display frame.

Accordingly, in this [period—TP $(5)_0$] through [period—TP $(5)_4$], the (n, m)th light emitting elements are in principle in a light nonemission state. That is to say, in [period—TP $(5)_0$] through [period—TP $(5)_1$] and [period—TP $(5)_3$] through [period—TP $(5)_4$], the first transistor $TR_1$ is in an "off" state, and thus the light emitting elements do not emit light. Note that in [period—TP $(5)_2$], the first transistor $TR_1$ is in an "on" state. However, in this period, threshold voltage cancel processing described later is performed. As will be described in detail in the explanation of threshold voltage cancel processing, if it is assumed that equation (2) described later is satisfied, the light emitting elements do not emit light.

The respective periods of [period—TP $(5)_0$] through [period—TP $(5)_4$] are firstly described hereinafter. Note that the start period of [period—TP $(5)_1$] and the lengths of the respective periods of [period—TP $(5)_1$] through [period—TP $(5)_4$] may be set suitably in accordance with the design of the display device.

[Period—TP $(5)_0$]

As was described above, in [period—TP $(5)_0$], the (n, m)th light emitting elements are in a light nonemission state. The write transistor $TR_W$, the second transistor $TR_2$, and the third transistor $TR_3$ are in an "off" state. Additionally, at the time of transition from [period—TP $(5)_{-1}$] to [period—TP $(5)_0$], because the first transistor $TR_1$ changes to an "off" state, the electric potential of the second node $ND_2$ (the source region of the drive transistor $TR_D$ or the anode electrode of the light emission unit ELP) falls to $(V_{th\text{-}EL}+V_{Cat})$, and the light emission unit ELP changes to a light nonemission state. Additionally, the electric potential of the first node $ND_1$ (the gate electrode of the drive transistor $TR_D$) in a floating state also falls, so as to follow the fall in the electric potential of the second node $ND_2$.

Figure 6B:
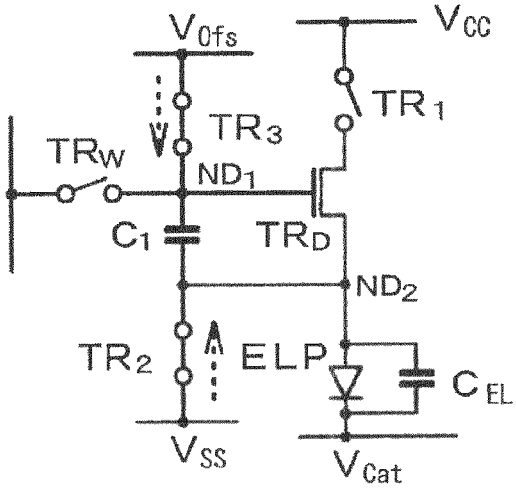
FIG. 6B is an explanatory diagram depicting on/off states and the like of each transistor of the 5Tr/1C drive circuit.
Figure 6C:
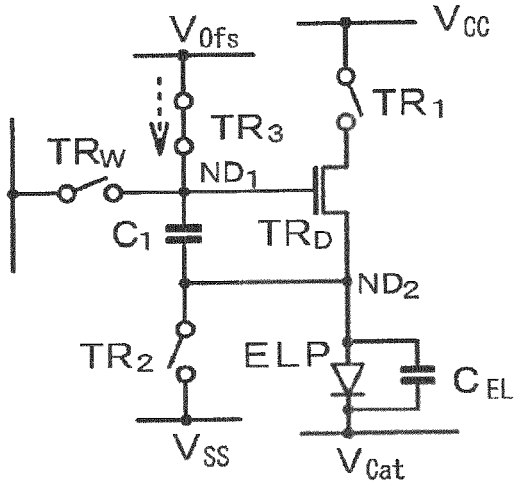
FIG. 6C is an explanatory diagram depicting on/off states and the like of each transistor of the 5Tr/1C drive circuit.

[Period—TP $(5)_1$] (Refer to FIG. 6B and FIG. 6C)

In this [period—TP $(5)_1$], preprocessing for performing threshold voltage cancel processing described later is performed. That is to say, at the start of [period—TP $(5)_1$], the second transistor $TR_2$ and the third transistor $TR_3$ are put in an "on" state by putting the second transistor control line $AZ_2$ and the third transistor control line $AZ_3$ at high level. As a result of this, the electric potential of the first node $ND_1$ changes to $V_{0fs}$ (for example, 0 volts). On the other hand, the electric potential of the second node $ND_2$ changes to $V_{SS}$ (for example, −10 volts). Accordingly, prior to completion of this [period—TP $(5)_1$], the second transistor $TR_2$ is put in an "off" state by putting the second transistor control line $AZ_2$ at low level. Note that the second transistor $TR_2$ and the third transistor $TR_3$ may be put in an "on" state simultaneously, the second transistor $TR_2$ may be put in an "on" state firstly, or the third transistor $TR_3$ may be put in an "on" state firstly.

Due to the foregoing processing, the electric potential difference between the gate electrode and the source region of the drive transistor $TR_D$ becomes $V_{th}$ or higher. The drive transistor $TR_D$ changes to an "on" state.

Figure 6D:
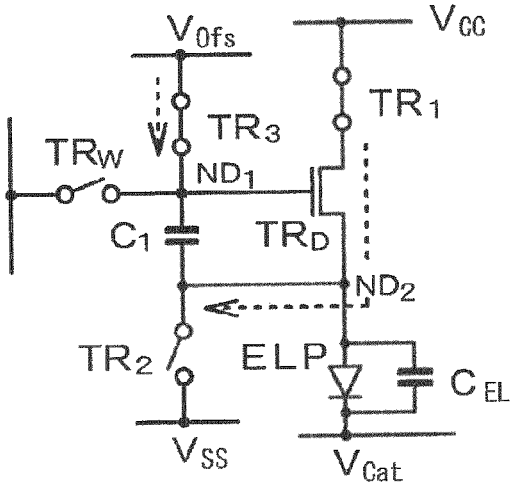
FIG. 6D is an explanatory diagram depicting on/off states and the like of each transistor of the 5Tr/1C drive circuit.

[Period—TP $(5)_2$] (Refer to FIG. 6D)

Next, threshold voltage cancel processing is performed. That is to say, the first transistor $TR_1$ is put in an "on" state by putting the first transistor control line $CL_1$ at high level while maintaining the third transistor $TR_3$ in an "on" state. As a result of this, the electric potential of the first node $ND_1$ does not change (maintaining $V_{0fs}$=0 volts), and the electric potential of the second node $ND_2$ changes toward an electric potential obtained by subtracting the threshold voltage $V_{th}$ of the drive transistor $TR_D$ from the electric potential of the first node $ND_1$. That is to say, the electric potential of the second node $ND_2$ in a floating state rises. Accordingly, when the electric potential difference between the gate electrode and the source region of the drive transistor $TR_D$ reaches $V_{th}$, the drive transistor $TR_D$ changes to an "off" state. Specifically, the electric potential of the second node $ND_2$ in a floating state approaches ($V_{0fs}-V_{th}=-3$ volts$>V_{SS}$), and ultimately becomes ($V_{0fs}-V_{th}$). Here, if equation (2) hereinafter is assured, or to state this differently, if the electric potential is selected and determined so as to satisfy equation (2), the light emission unit ELP does not emit light.

$$(V_{0fs}-V_{th})<(V_{th\text{-}EL}+V_{Cat}) \tag{2}$$

In this [period—TP $(5)_2$], the electric potential of the second node $ND_2$ ultimately becomes ($V_{0fs}-V_{th}$). That is to say, the electric potential of the second node $ND_2$ is determined dependent only on the threshold voltage $V_{th}$ of the drive transistor $TR_D$ and the voltage $V_{0fs}$ for initializing the gate electrode of the drive transistor $TR_D$. Stated differently, there is no dependence on the threshold voltage $V_{th\text{-}EL}$ of the light emission unit ELP.

Figure 6E:
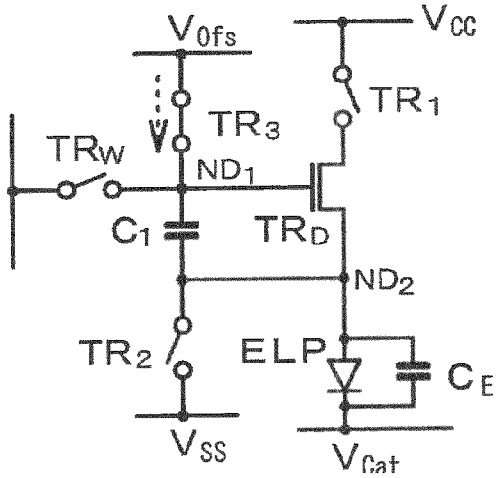
FIG. 6E is an explanatory diagram depicting on/off states and the like of each transistor of the 5Tr/1C drive circuit.

[Period—TP $(5)_3$] (Refer to FIG. 6E)

Thereafter, the first transistor $TR_1$ is put in an "off" state by putting the first transistor control line $CL_1$ at low level while maintaining the third transistor $TR_3$ in an "on" state. As a result of this, the electric potential of the first node $ND_1$ is held unchanged (maintaining $V_{0fs}=0$ volts) and the electric potential of the second node $ND_2$ also is held unchanged ($V_{0fs}-V_{th}=-3$ volts).

Figure 6F:
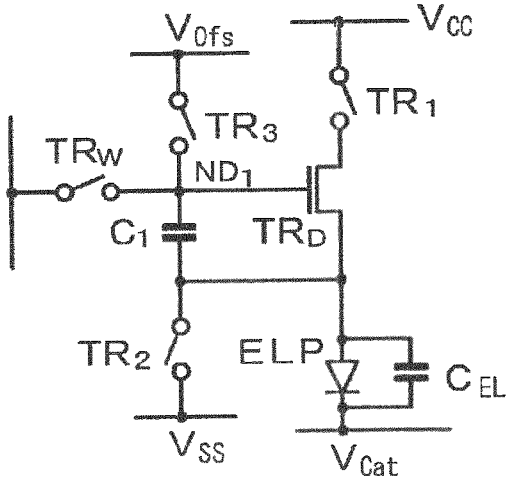
FIG. 6F is an explanatory diagram depicting on/off states and the like of each transistor of the 5Tr/1C drive circuit.

[Period—TP $(5)_4$] (Refer to FIG. 6F)

Next, the third transistor $TR_3$ is put in an "off" state by putting the third transistor control line $AZ_3$ at low level. As a result of this, the electric potentials of the first node $ND_1$ and the second node $ND_2$ substantially do not change. In actuality, electric potential changes can occur due to electrostatic coupling of parasitic capacitance or the like, but, normally, these can be ignored.

Next, the respective periods of [period—TP $(5)_5$] through [period—TP $(5)_7$] are described. Note that, as is described later, write processing is performed in [period—TP $(5)_5$], and mobility correction processing is performed in [period—TP $(5)_6$]. As was described above, performing these sets of processing within the mth horizontal scanning period is necessary. For convenience of explanation, a start period of [period—TP $(5)_5$] and an end period of [period—TP $(5)_6$] are explained as coinciding respectively with the start period and the end period of the mth horizontal scanning period.

Figure 6G:
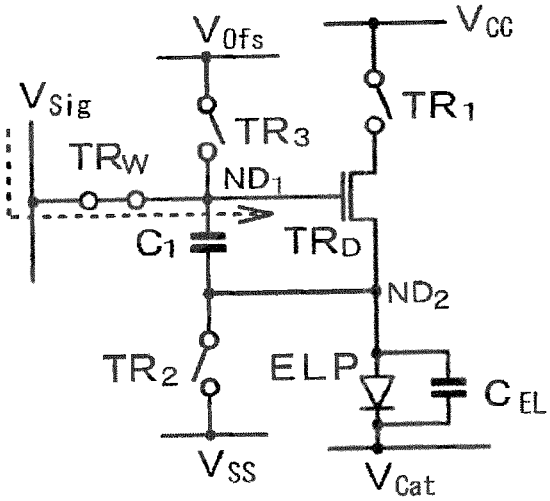
FIG. 6G is an explanatory diagram depicting on/off states and the like of each transistor of the 5Tr/1C drive circuit.

[Period—TP $(5)_5$] (Refer to FIG. 6G)

Thereafter, write processing is executed with respect to the drive transistor $TR_D$. Specifically, the write transistor $TR_W$ is put in an "on" state by putting the electric potential of the data line DTL to the video signal $V_{Sig}$ for controlling the luminance at the light emission unit ELP, and then putting the scanning line SCL at high level, while maintaining an "off" state of the first transistor $TR_1$, the second transistor $TR_2$, and the third transistor $TR_3$. As a result of this, the electric potential of the first node $ND_1$ rises to $V_{Sig}$.

Here, capacitance of the capacitor $C_1$ is indicated by a value $c_1$, and capacitance of the capacitance $C_{EL}$ of the light emission unit ELP is indicated by a value $c_{EL}$. Accordingly, the value of parasitic capacitance between the gate electrode and the source region of the drive transistor $TR_D$ is taken to be $c_{gs}$. When the electric potential of the gate electrode of the drive transistor $TR_D$ has changed from $V_{0fs}$ to $V_{Sig}$ ($>V_{0fs}$), the electric potentials of the two ends of the capacitor $C_1$ (the electric potentials of the first node $ND_1$ and the second node $ND_2$), in principle, change. That is to say, an electric charge based on the amount of change ($V_{Sig}-V_{0fs}$) in the electric potential of the gate electrode of the drive transistor $TR_D$ (=the electric potential of the first node $ND_1$) is allocated to capacitor $C_1$, the capacitance $C_{EL}$ of the light emission unit ELP, and the parasitic capacitance between the gate electrode and the source region of the drive transistor $TR_D$. However, if the value $c_{EL}$ is sufficiently large in comparison with the value $c_1$ and the value $c_{gs}$, change is small for the electric potential of the source region (second node $ND_2$) of the drive transistor $TR_D$ based on the amount of change ($V_{Sig}-V_{0fs}$) in the electric potential of the gate electrode of the drive transistor $TR_D$. Accordingly, generally, the capacitance value $c_{EL}$ of the capacitance $C_{EL}$ of the light emission unit ELP is larger than the capacitance value $c_i$ of the capacitor $C_1$ and the value $c_{gs}$ of the parasitic capacitance of the drive transistor $TR_D$. In this regard, for convenience of explanation, except in cases where there is special need, explanation is given without consideration for change in the electric potential of the second node $ND_2$ occurring due to change in the electric potential of the first node $ND_1$. This is similar for other drive circuits as well. Note that, in the timing chart of drive depicted in FIG. 5 as well, depiction is made without consideration for change in the electric potential of the second node $ND_2$ occurring due to change in the electric potential of the first node $ND_1$. When the electric potential of the gate electrode (first node $ND_1$) of the drive transistor $TR_D$ is taken to be $V_g$ and the electric potential of the source region (second node $ND_2$) of the drive transistor $TR_D$ is taken to be $V_s$, the value of $V_g$ and the value of $V_s$ change as indicated below. Thus, the electric potential difference of the first node $ND_1$ and the second node $ND_2$, or in other words, the electric potential difference $V_{gs}$ between the gate electrode and the source region of the drive transistor $TR_D$, can be expresses by equation (3) below.

$$V_g=V_{Sig}$$

$$V_s\approx V_{0fs}-V_{th}$$

$$V_{gs}\approx V_{Sig}-(V_{0fs}-V_{th}) \tag{3}$$

That is to say, $V_{gs}$, obtained by write processing with respect to the drive transistor $TR_D$, is dependent only on the video signal $V_{Sig}$ for controlling luminance at the light emission unit ELP, the threshold voltage $V_{th}$ of the drive transistor $TR_D$, and the voltage $V_{0fs}$ for initializing the gate electrode of the drive transistor $TR_D$. Accordingly, it is unrelated to the threshold voltage $V_{th\text{-}EL}$ of the light emission unit ELP.

Figure 6H:
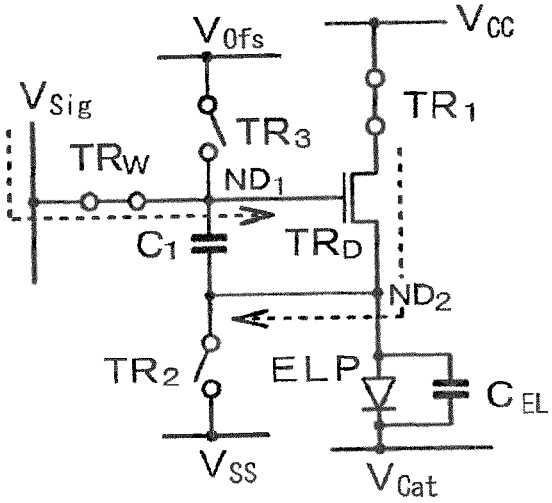
FIG. 6H is an explanatory diagram depicting on/off states and the like of each transistor of the 5Tr/1C drive circuit.

[Period—TP $(5)_6$] (Refer to FIG. 6H)

Thereafter, correction (mobility correction processing) of the electric potential of the source region (second node $ND_2$) of the drive transistor $TR_D$ is performed on a basis of the size of the mobility μ of the drive transistor $TR_D$.

Generally, when the drive transistor $TR_D$ has been fabricated from a polysilicon thin film transistor or the like, occurrence of variation in the mobility between transistors is difficult to avoid. Consequently, even when the video signal $V_{Sig}$ having an identical value is applied to the gate electrodes of a plurality of drive transistors $TR_D$ in which differences in the mobility μ exist, differences occur between the drain current $I_{ds}$ flowing through drive transistors $TR_D$ having a large mobility μ and the drain current $I_{ds}$ flowing through drive transistors $TR_D$ having a small mobility μ. Accordingly, when this kind of difference occurs, uniformity of the screen of the display device is lost.

Consequently, specifically, the first transistor $TR_1$ is put into an "on" state by putting the first transistor control line $CL_1$ at high level while maintaining an "on" state of the write transistor $TR_W$, and subsequently, after a predetermined time ($t_0$) has elapsed, the write transistor $TR_W$ is put in an "off" state and the first node $ND_1$ (the gate electrode of the drive transistor $TR_D$) is put in a floating state by putting the scanning line SCL at low level. Accordingly, as a result of the foregoing, in a case where the value of the mobility μ of the drive transistor $TR_D$ is large, a rise quantity ΔV (electric potential correction value) of the electric potential at the source region of the drive transistor $TR_D$ becomes large, and in a case where the value of the mobility μ of the drive transistor $TR_D$ is small, the rise quantity ΔV (electric potential correction value) of the electric potential at the source region of the drive transistor $TR_D$ becomes small. Here, the electric potential difference $V_{gs}$ between the gate electrode and the source region of the drive transistor $TR_D$ is transformed from equation (3) to equation (4) below.

$$V_{gs} \approx V_{Sig} - (V_{0fs} - V_{th}) - \Delta V \quad (4)$$

Note that the predetermined time (total time $t_0$ of [period—TP $(5)_6$]) for executing mobility correction processing may, during design of the display device, be priorly determined as a design value. Additionally, the total time $t_0$ of [period—TP $(5)_6$] is determined so that the electric potential ($V_{0fs} - V_{th} + \Delta V$) at the source region of the drive transistor $TR_D$ at this time satisfies equation (2') below. Accordingly, due to this, the light emission unit ELP does not emit light in [period—TP $(5)_6$]. Further, correction of variation in a coefficient k ($\equiv 1/2) \cdot (W/L) \cdot C_{ox}$) also is performed simultaneously by this mobility correction processing.

$$(V_{0fs} - V_{th} + \Delta V) < (V_{th\text{-}EL} + V_{Cat}) \quad (2')$$

Figure 6I:
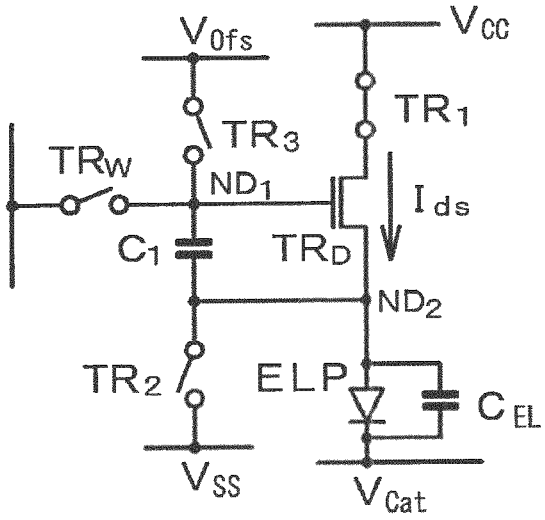
FIG. 6I is an explanatory diagram depicting on/off states and the like of each transistor of the 5Tr/1C drive circuit.

[Period—TP $(5)_7$] (Refer to FIG. 6I)

The threshold voltage cancel processing, the write processing, and the mobility correction processing are completed by the foregoing operations. As an incidental comment, as a result of the scanning line SCL changing to low level, the write transistor $TR_W$ changes to an "off" state and the first node $ND_1$, that is to say, the gate electrode of the drive transistor $TR_D$, changes to a floating state. On the other hand, the first transistor $TR_1$ maintains an "on" state, and the drain region of the drive transistor $TR_D$ is in a state of connection to the electric power source unit 2100 (voltage $V_{CC}$, for example 20 volts). Consequently, as a result of the foregoing, the electric potential of the second node $ND_2$ rises.

Here, as was described above, the gate electrode of the drive transistor $TR_D$ is in a floating state, and moreover, the capacitor $C_1$ exists. Therefore, a phenomenon similar to that in what is known as a bootstrap circuit occurs at the gate electrode of the drive transistor $TR_D$, and the electric potential of the first node $ND_1$ also rises. As a result, the electric potential difference $V_{gs}$ between the gate electrode and the source region of the drive transistor $TR_D$ maintains the value of equation (4).

Additionally, the electric potential of the second node $ND_2$ rises and exceeds ($V_{th\text{-}EL} + V_{Cat}$), and thus the light emission unit ELP starts to emit light. At this time, the current flowing through the light emission unit ELP is the drain current $I_{ds}$ flowing from the drain region to the source region of the drive transistor $TR_D$, and thus can be expressed by equation (1). Here, based on equation (1) and equation (4), equation (1) can be transformed into equation (5) below.

$$I_{ds} = k \cdot \mu \cdot (V_{Sig} - V_{0fs} - \Delta V)^2 \quad (5)$$

Consequently, for example, in a case where $V_{0fs}$ has been set at 0 volts, the current $I_{ds}$ flowing through the light emission unit ELP is proportional to the square of the value obtained by subtracting the value of the electric potential correction value ΔV at the second node $ND_2$ (the source region of the drive transistor $TR_D$) arising from the mobility μ of the drive transistor $TR_D$ from the value of the video signal $V_{Sig}$ for controlling the luminance at the light emission unit ELP. Stated differently, the current $I_{ds}$ flowing through the light emission unit ELP is not dependent on the threshold voltage $V_{th\text{-}EL}$ of the light emission unit ELP and the threshold voltage $V_{th}$ of the drive transistor $TR_D$. That is to say, the amount of light emission (luminance) of the light emission unit ELP is not subject to an effect by the threshold voltage $V_{th\text{-}EL}$ of the light emission unit ELP and an effect by the threshold voltage $V_{th}$ of the drive transistor $TR_D$. The luminance of the (n, m)th light emitting elements is a value that corresponds to the current $I_{ds}$.

Moreover, the larger is the mobility μ of the drive transistor $TR_D$, the larger becomes the electric potential correction value ΔV, and thus the smaller becomes the value of $V_{gs}$ of the left side of equation (4). Consequently, in equation (5), as a result of the value of $(V_{Sig} - V_{0fs} - \Delta V)^2$ becoming small even when the value of the mobility μ is large, the drain current $I_{ds}$ can be corrected. That is to say, even in the drive transistors $TR_D$ of differing mobility μ, if the value of the video signal $V_{Sig}$ is the same, the drain current $I_d$, comes to be substantially the same, and as a result, it flows through the light emission unit ELP. Thus, the current $I_{ds}$ for controlling the luminance of the light emission unit ELP is made uniform. That is to say, variations in luminance of the light emission unit arising from variations in the mobility μ (and moreover, variation in k) can be corrected.

The light emission state of the light emission unit ELP continues until the (m+m'−1)th horizontal scanning period. This time point corresponds to the end of [period—TP $(5)_{-1}$].

Light emission operation of light emitting elements 10 constituting (n, m)th sub-pixels is completed by the foregoing.

Next, explanation of a 2Tr/1C drive circuit will be made.

[2Tr/1C Drive Circuit]

Figure 7:
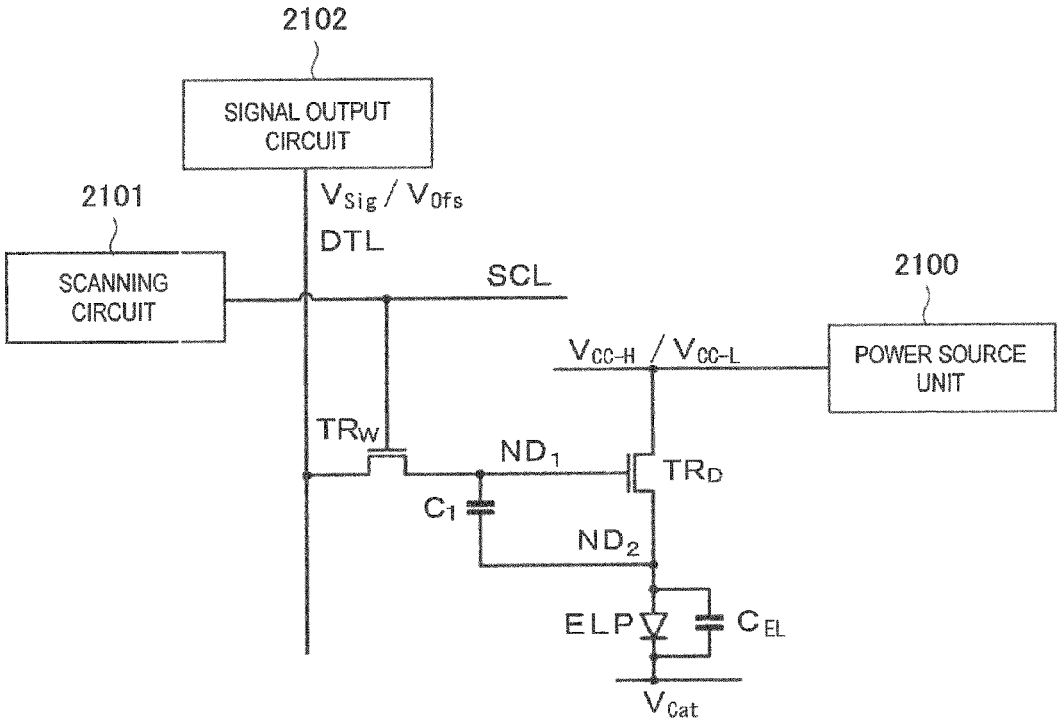
FIG. 7 is an equivalent circuit diagram of a 2Tr/1C drive circuit.
Figure 8:
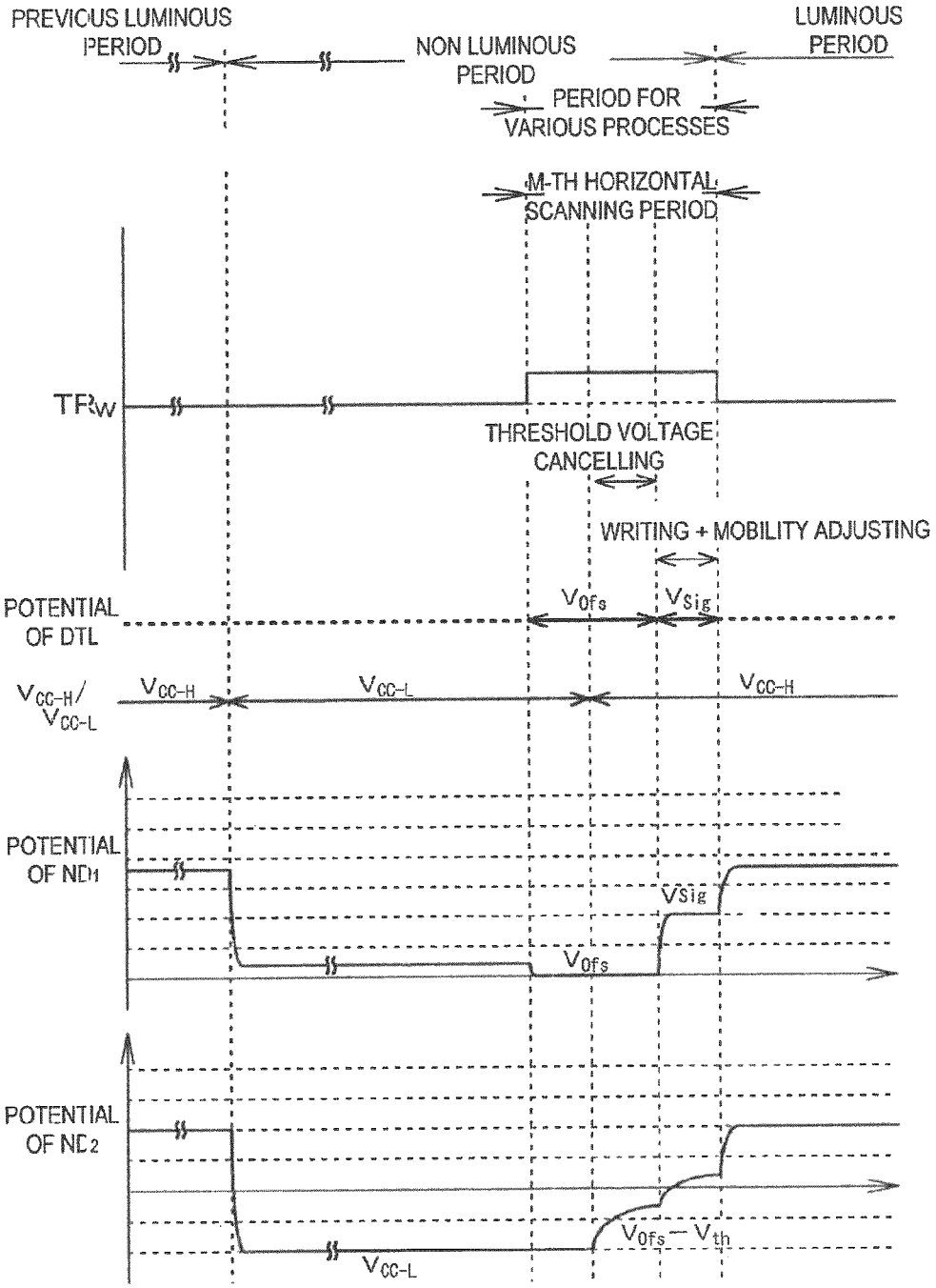
FIG. 8 is a timing chart of drive of the 2Tr/1C drive circuit.

An equivalent circuit diagram of the 2Tr/1C drive circuit is depicted in FIG. 7, a timing chart of drive is depicted schematically in FIG. 8, and on/off states and the like of each transistor of the 2Tr/1C drive circuit are depicted schematically in FIG. 9A through FIG. 9F.

Three transistors in the above-described 5Tr/1C drive circuit, being the first transistor $TR_1$, the second transistor $TR_2$, and the third transistor $TR_3$, are omitted from this 2Tr/1C drive circuit. That is to say, this 2Tr/1C drive circuit is constituted by two transistors, being the write transistor $TR_W$ and the drive transistor $TR_D$, and further is constituted by one capacitor $C_1$.

[Drive Transistor $TR_D$]

The structure of the drive transistor $TR_D$ is the same as the structure of the drive transistor $TR_D$ described for the 5Tr/1C drive circuit, and thus detailed explanation is omitted. Note, however, that the drain region of the drive transistor $TR_D$ is connected to the electric power source unit 2100. Note also that voltage $V_{CC\text{-}H}$ for causing the light emission unit ELP to emit light and voltage $V_{CC\text{-}L}$ for controlling the electric potential of the source region of the drive transistor $TR_D$ are supplied from the electric power source unit 2100. Here, as values of voltages $V_{CC\text{-}H}$ and $V_{CC\text{-}L}$, $V_{CC\text{-}H} = 20$ volts $V_{CC\text{-}L} = -10$ volts are used by way of example, but there is no limitation to these values.

[Write Transistor $TR_W$]

The structure of the write transistor $TR_W$ is the same as the structure of the write transistor $TR_W$ described for the 5Tr/1C drive circuit, and thus detailed explanation is omitted.

[Light Emission Unit ELP]

The structure of the light emission unit ELP is the same as the structure of the light emission unit ELP described for the 5Tr/1C drive circuit, and thus detailed explanation is omitted.

Operation of the 2Tr/1C drive circuit will be described hereinafter.

Figure 9A:
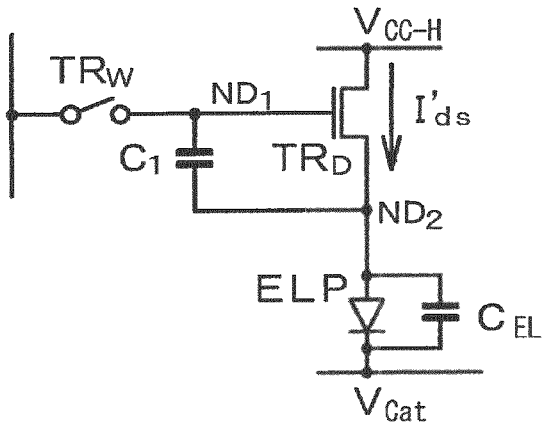
FIG. 9A is an explanatory diagram depicting on/off states and the like of each transistor of the 2Tr/1C drive circuit.

[Period—TP $(2)_{-1}$] (Refer to FIG. 8 and FIG. 9A)

This [period—TP $(2)_{-1}$] is, for example, operation in a previous display frame, and is substantially the same operation of [period—TP $(5)_{-1}$] described for the 5Tr/1C drive circuit.

[Period—TP $(2)_0$] through [period—TP $(2)_2$] depicted in FIG. 8 are periods corresponding to [period—TP $(5)_0$] through [period—TP $(5)_4$] depicted in FIG. 5, and are an operation period until immediately before the next write processing is performed. Similarly to the 5Tr/1C drive circuit, in [period—TP $(2)_0$] through [period—TP $(2)_2$], the (n, m)th light emitting elements are in principle in a light nonemission state. Note, however, that in the operation of the 2Tr/1C drive circuit, as depicted in FIG. 8, aside from [period—TP $(2)_3$], the matter of [period—TP $(2)_1$] through [period—TP $(2)_2$] also including an mth horizontal scanning period differs from the operation of the 5Tr/1C drive circuit. Not also that, for convenience of explanation, a start period of [period—TP $(2)_1$] and an end period of [period—TP $(2)_3$] are explained as coinciding respectively with the start period and the end period of the mth horizontal scanning period.

The respective periods of [period—TP $(2)_0$] through [period—TP $(2)_2$] are described hereinafter. Note that similarly to what was explained for the 5Tr/1C drive circuit, the lengths of the respective periods of [period—TP $(2)_1$] through [period—TP $(2)_3$] may be set suitably in accordance with the design of the display device.

Figure 9B:
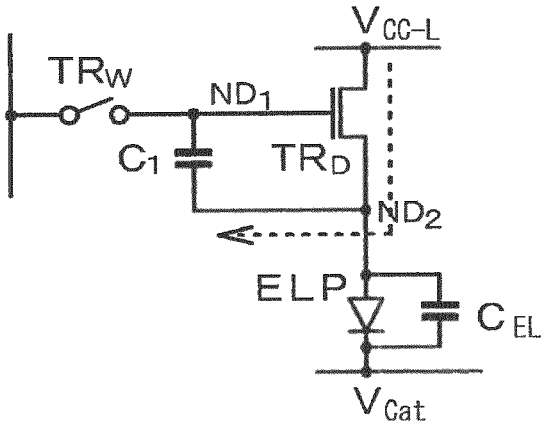
FIG. 9B is an explanatory diagram depicting on/off states and the like of each transistor of the 2Tr/1C drive circuit.

[Period—TP $(2)_0$] (Refer to FIG. 9B)

This [period—TP $(2)_0$] is, for example, operation from the previous display frame to the present display frame. That is to say, this [period—TP $(2)_0$] is the period from the (m+m')th horizontal scanning period in the previous display frame to the (m−1)th horizontal scanning period in the present display frame. In this [period—TP $(2)_0$], the (n, m)th light emitting elements are in a light nonemission state. Here, at the time point of change from [period—TP $(2)_{-1}$] to [period—TP $(2)_0$], the voltage supplied from the electric power source unit 2100 is switched from $V_{CC-H}$ to $V_{CC-L}$. As a result, the electric potential of the second node $ND_2$ falls to $V_{CC-L}$, and the light emission unit ELP changes to a light nonemission state. Further, the electric potential of the first node $ND_1$ (the gate electrode of the drive transistor $TR_D$) in a floating state also falls, so as to follow the fall in the electric potential of the second node $ND_2$.

Figure 9C:
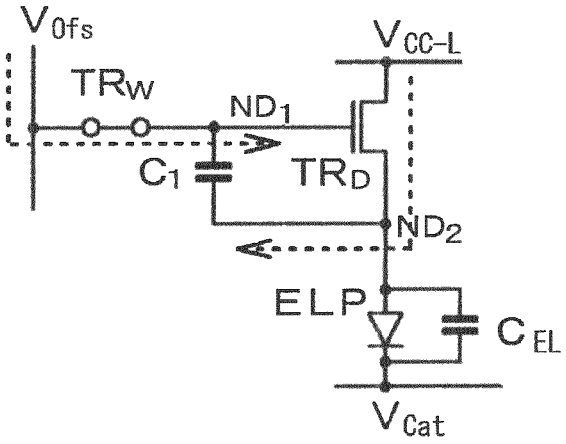
FIG. 9C is an explanatory diagram depicting on/off states and the like of each transistor of the 2Tr/1C drive circuit.

[Period—TP $(2)_1$] (Refer to FIG. 9C)

Then, the mth horizontal scanning period starts in the present display frame. In this [period—TP $(2)_1$], preprocessing for performing threshold voltage cancel processing is performed. At the time of the start of [period—TP $(2)_1$], the write transistor $TR_W$ is put in an "on" state by putting the scanning line SCL at high level. As a result, the electric potential of the first node $ND_1$ changes to $V_{0fs}$ (for example, 0 volts). The electric potential of the second node $ND_2$ maintains $V_{CC-L}$ (for example, −10 volts).

Due to the above-described operation, the electric potential difference between the gate electrode and the source region of the drive transistor $TR_D$ becomes $V_{th}$ or higher, and the drive transistor $TR_D$ changes to an "on" state.

Figure 9D:
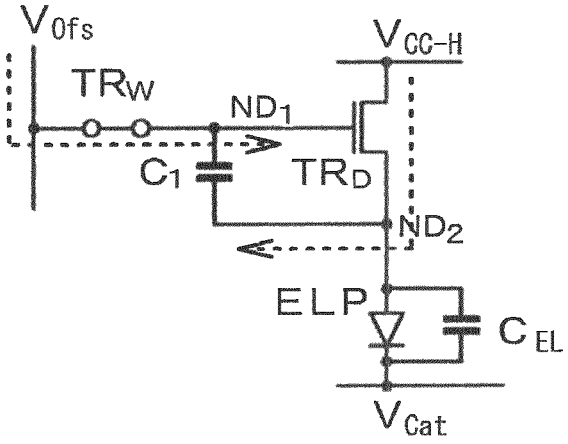
FIG. 9D is an explanatory diagram depicting on/off states and the like of each transistor of the 2Tr/1C drive circuit.

[Period—TP $(2)_2$] (Refer to FIG. 9D)

Next, threshold voltage cancel processing is performed. That is to say, the voltage supplied from the electric power source unit 2100 is switched from $V_{CC-L}$ to $V_{CC-H}$ while the "on" state of the write transistor $TR_W$ is maintained. As a result of this, the electric potential of the first node $ND_1$ does not change (maintaining $V_{0fs}$=0 volts), meanwhile the electric potential of the second node $ND_2$ changes toward an electric potential obtained by subtracting the threshold voltage $V_{th}$ of the drive transistor $TR_D$ from the electric potential of the first node $ND_1$. That is to say, the electric potential of the second node $ND_2$ in a floating state rises. When the electric potential difference between the gate electrode and the source region of the drive transistor $TR_D$ reaches $V_{th}$, the drive transistor $TR_D$ changes to an "off" state. Specifically, the electric potential of the second node $ND_2$ in a floating state approaches ($V_{0fs}-V_{th}$=−3 volts), and ultimately becomes ($V_{0fs}-V_{th}$). Here, if the above-described equation (2) is assured, or to state this differently, if the electric potential is selected and determined so as to satisfy equation (2), the light emission unit ELP does not emit light.

In this [period—TP $(2)_2$], the electric potential of the second node $ND_2$ ultimately becomes ($V_{0fs}-V_{th}$). That is to say, the electric potential of the second node $ND_2$ is determined dependent only on the threshold voltage $V_{th}$ of the drive transistor $TR_D$ and the voltage $V_{0fs}$ for initializing the gate electrode of the drive transistor $TR_D$. Accordingly, there is no relationship with the threshold voltage $V_{th-EL}$ of the light emission unit ELP.

Figure 9E:
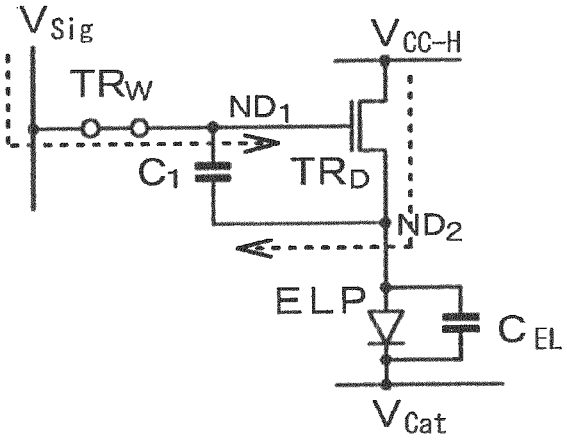
FIG. 9E is an explanatory diagram depicting on/off states and the like of each transistor of the 2Tr/1C drive circuit.
Figure 9F:
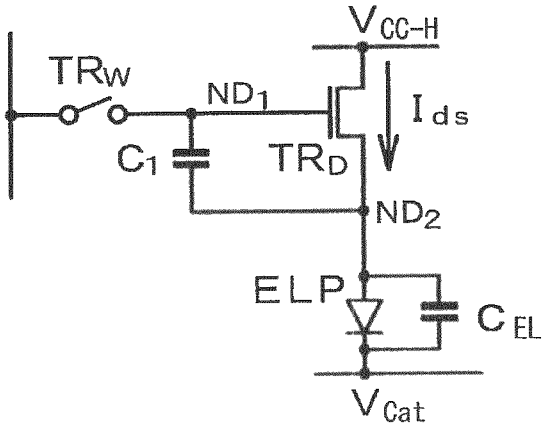
FIG. 9F is an explanatory diagram depicting on/off states and the like of each transistor of the 2Tr/1C drive circuit.

[Period—TP $(2)_3$] (Refer to FIG. 9E)

Next are performed write processing with respect to the drive transistor $TR_D$, and correction (mobility correction processing) of the electric potential of the source region (second node $ND_2$) of the drive transistor $TR_D$ on a basis of the size of the mobility μ of the drive transistor $TR_D$. Specifically, the electric potential of the data line DTL is put to the video signal $V_{Sig}$ for controlling the luminance at the light emission unit ELP while maintaining the "on" state of the write transistor $TR_W$. As a result of this, the electric potential of the first node $ND_1$ rises to $V_{Sig}$, and the drive transistor $TR_D$ changes to an "on" state. Note that the drive transistor $TR_D$ may be put into an "on" state by temporarily putting the write transistor $TR_W$ in an "off" state, changing the electric potential of the data line DTL to the video signal $V_{Sig}$ for controlling the luminance at the light emission unit ELP, and thereafter putting the scanning line SCL at high level and thereby putting the write transistor $TR_W$ in an "on" state.

Unlike what was explained for the 5Tr/1C drive circuit, electric potential $V_{CC-H}$ is applied to the drain region of the drive transistor $TR_D$ from the electric power source unit 2100, and thus the electric potential of the source region of the drive transistor $TR_D$ rises. After the predetermined time ($t_0$) has elapsed, the write transistor $TR_W$ is put in an "off" state by putting the scanning line SCL at low level, and the first node $ND_1$ (the gate electrode of the drive transistor $TR_D$) is put in a floating state. Note that the total time $t_0$ of this [period—TP $(2)_3$] may, during design of the display device, be priorly determined as a design value such that the electric potential of the second node $ND_2$ becomes ($V_{0fs}-V_{th}+\Delta V$).

In this [period—TP $(2)_3$], in a case where the value of the mobility μ of the drive transistor $TR_D$ is large, the rise quantity ΔV of the electric potential at the source region of the drive transistor $TR_D$ is large, and in a case where the value of the mobility μ of the drive transistor $TR_D$ is small, the rise quantity ΔV of the electric potential at the source region of the drive transistor $TR_D$ is small.

[Period—TP $(2)_4$] (Refer to FIG. 9E)

The threshold voltage cancel processing, the write processing, and the mobility correction processing are completed by the foregoing operations. Then, the same processing as [period—TP $(5)_7$] described for the 5Tr/1C drive circuit is performed, the electric potential of the second node $ND_2$ rises and exceeds ($V_{th\text{-}EL}+V_{Cat}$), and thus the light emission unit ELP starts to emit light. At this time, the current flowing through the light emission unit ELP can be obtained using the above-described equation (5), and thus the current $I_{ds}$ flowing through the light emission unit ELP is not dependent on the threshold voltage $V_{th\text{-}EL}$ of the light emission unit ELP and the threshold voltage $V_{th}$ of the drive transistor $TR_D$. That is to say, the amount of light emission (luminance) of the light emission unit ELP is not subject to an effect by the threshold voltage $V_{th\text{-}EL}$ of the light emission unit ELP and an effect by the threshold voltage $V_{th}$ of the drive transistor $TR_D$. Moreover, occurrence of variations in the drain current $I_{ds}$ arising from variations in the mobility μ of the drive transistor $TR_D$ can be suppressed.

The light emission state of the light emission unit ELP continues until the (m+m'−1)th horizontal scanning period. This time point corresponds to the end of [period—TP $(2)_{-1}$].

Light emission operation of the light emitting elements 10 constituting (n, m)th sub-pixels is completed by the foregoing.

Figure 10:
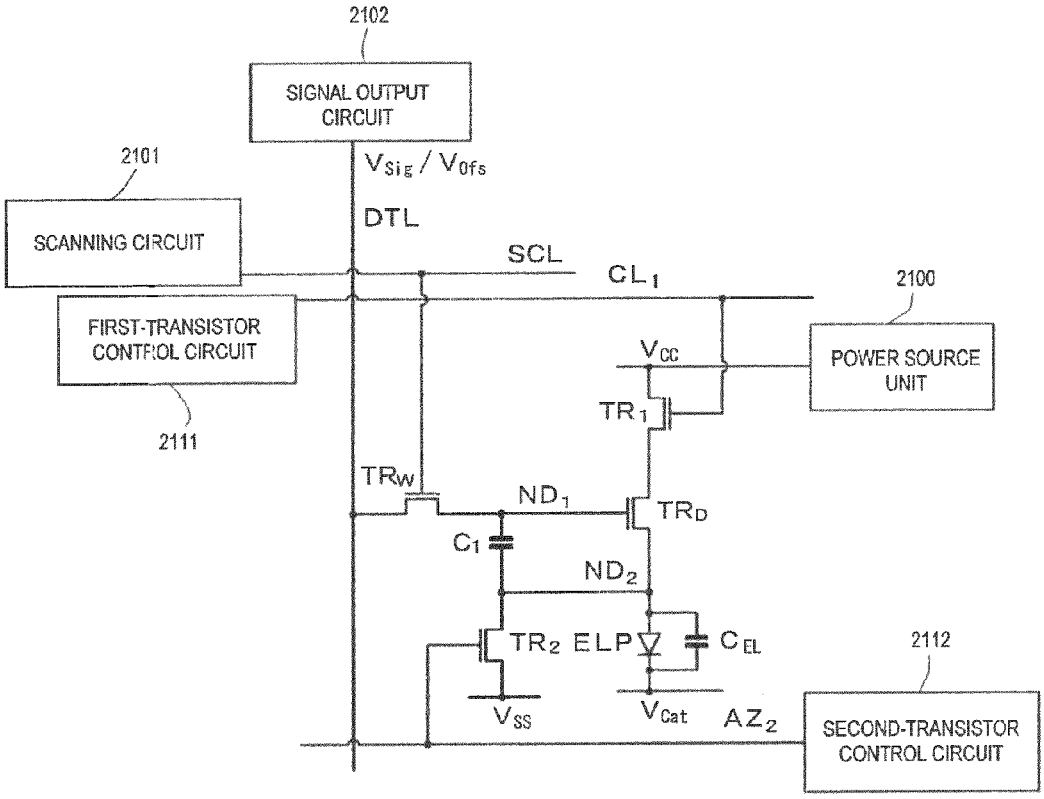
FIG. 10 is an equivalent circuit diagram of a 4Tr/1C drive circuit.
Figure 11:
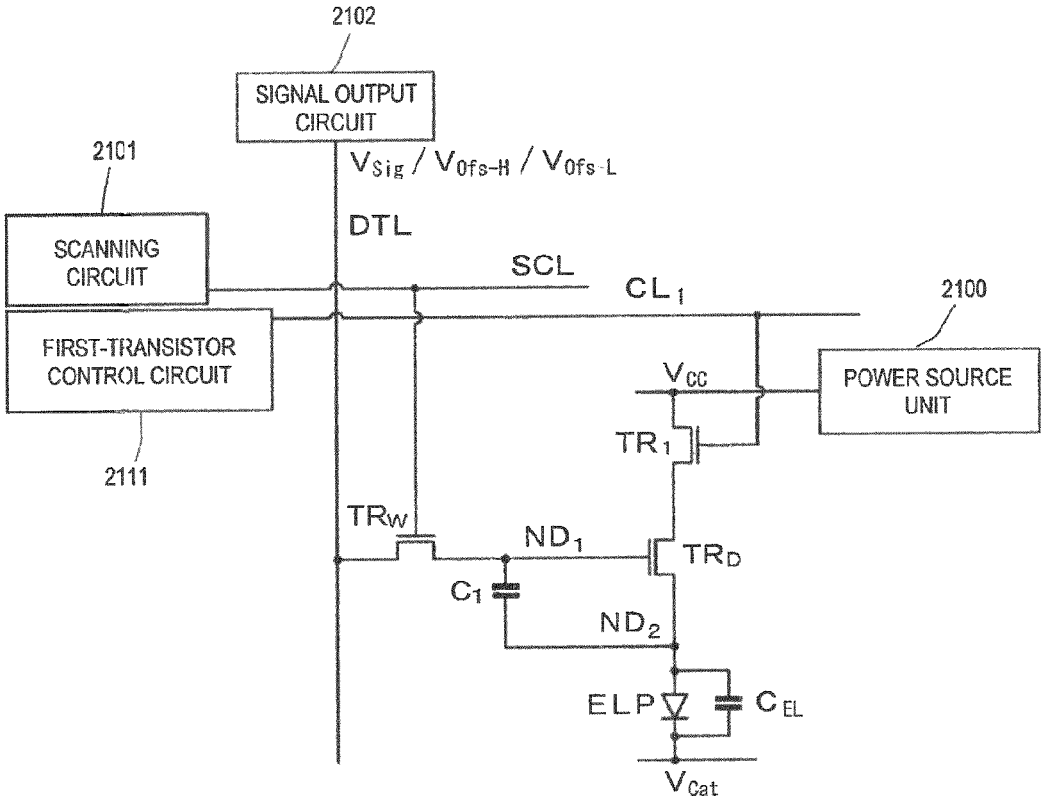
FIG. 11 is an equivalent circuit diagram of a 3Tr/1C drive circuit.

Explanation based on desirable examples was given above, but the structure of the drive circuit according to the present invention is not limited to these examples. The constitution and structure of the respective types of constituent elements making up the display device, the light emitting elements, and the drive circuit and the steps in the drive method of the light emission unit explained for the respective examples are exemplifications, and can be changed suitably. For example, the 4Tr/1C drive circuit depicted in FIG. 10 or the 3Tr/1C drive circuit depicted in FIG. 11 can be employed as the drive circuit.

Additionally, in the explanation of operation of the 5Tr/1C drive circuit, write processing and mobility correction were performed discretely, but there is no limitation to this. A structure can be used in which mobility correction processing is also performed in write processing, similarly to the explanation of operation of the 2Tr/1C drive circuit. Specifically, a structure may be used that applies a video signal $V_{Sig_m}$ from the data line DTL to a first node via a write transistor $T_{Sig}$ while a light emission controlling transistor $T_{EL_C}$ is in an "on" state.

The signal level correction unit 128 and structural elements relating to the signal level correction unit 128 according to the embodiment of the present invention will be described below.

Figure 12:
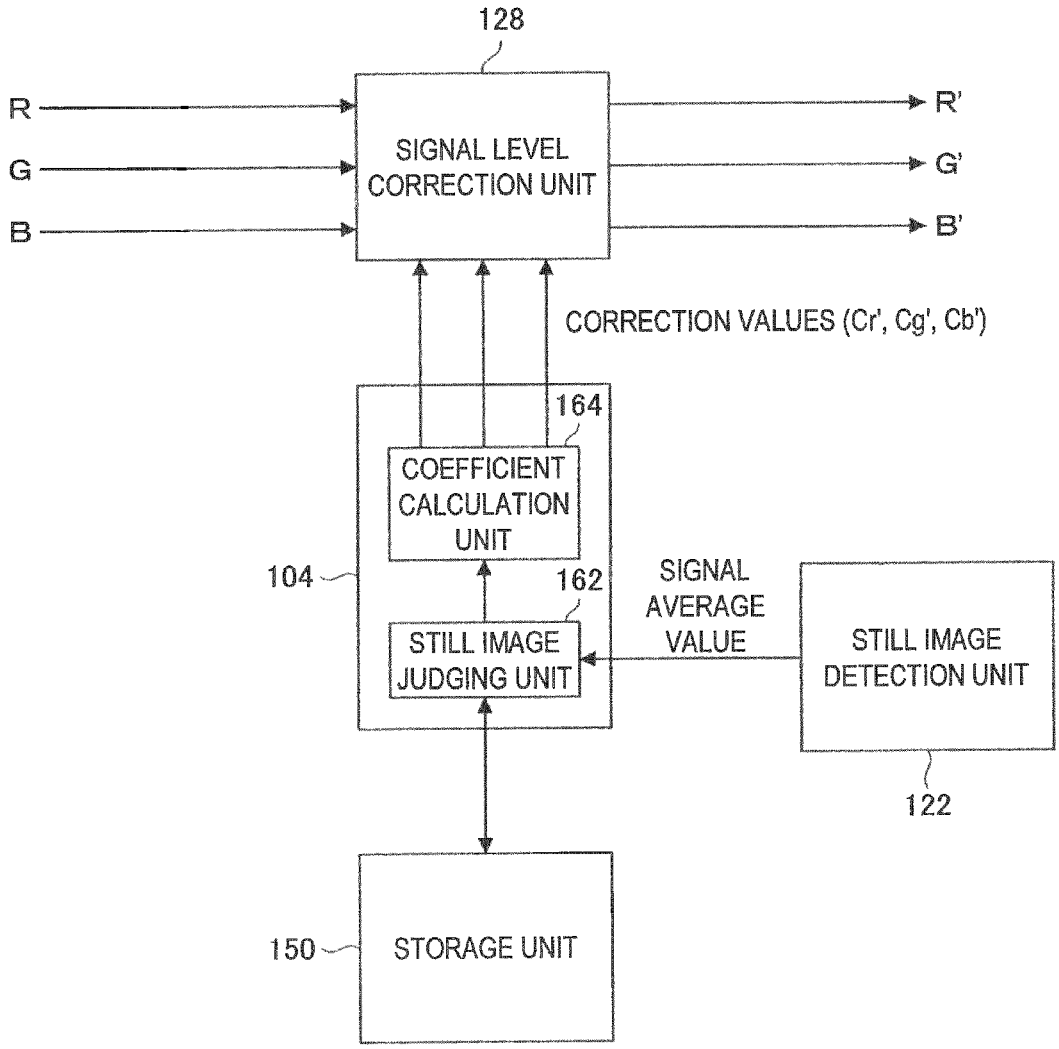
FIG. 12 is an explanatory diagram explaining a signal level correction unit 128 and structural components relating to the signal level correction unit 128.

FIG. 12 is an explanatory diagram explaining the signal level correction unit 128 and the structural elements relating to the signal level correction unit 128 according to the embodiment of the present invention. The signal level correction unit 128 and the structural elements relating to the signal level correction unit 128 according to the embodiment of the present invention will be described below in detail with reference to FIG. 12.

The still image detection unit 122 sequentially inputs video signals, and calculates an average value of the signal levels of respective colors R, G, and B per pixel based on the input video signals. The control unit 104 judges whether a still image is displayed by using the average value of the signal levels of respective colors R, G, and B calculated by the still image detection unit 122.

The judgment of whether the still image is displayed according to this embodiment is made in each of divided regions which are obtained by dividing an image display region on the screen into a plurality of regions. For this reason, the still image detection unit 122 calculates the average value of the signal levels of respective colors R, G, and B per pixel in each of the divided regions, and sends the calculated average value to the control unit 104.

Figure 13:
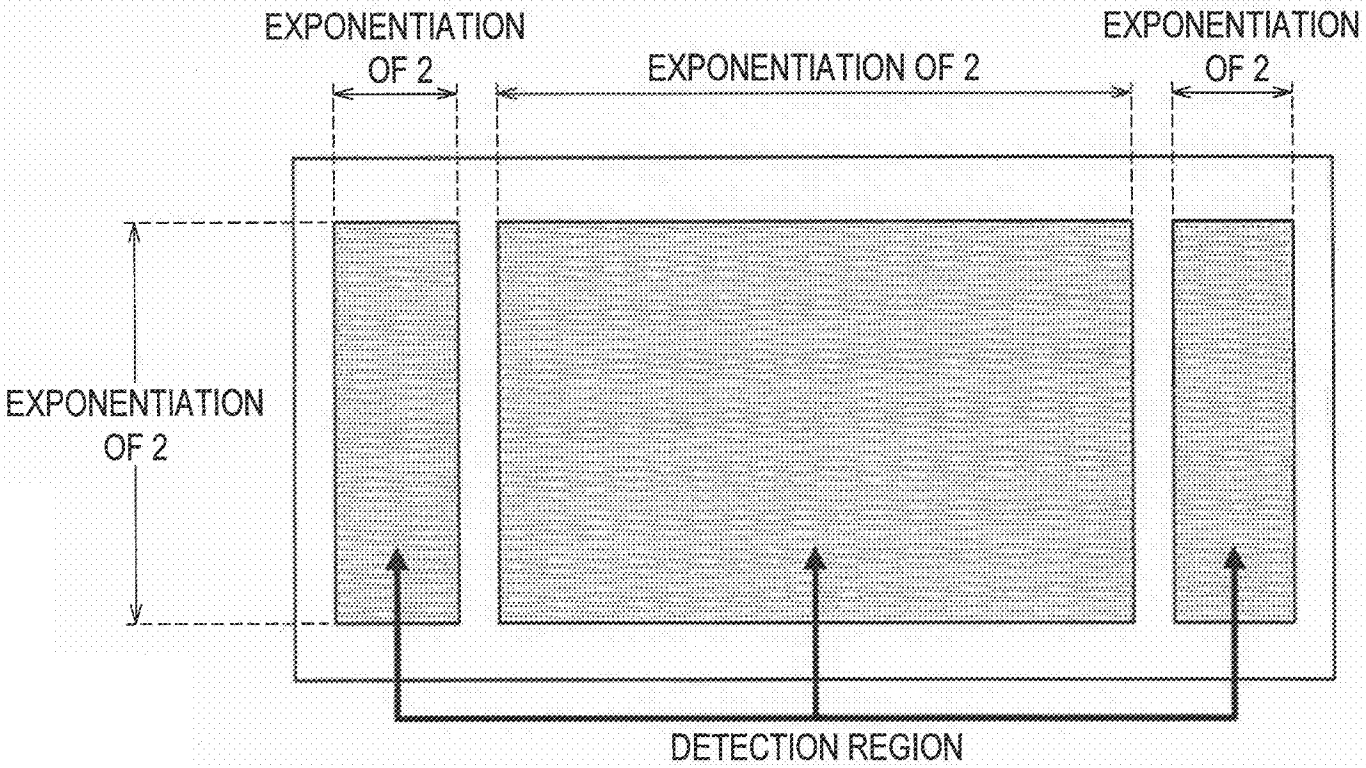
FIG. 13 is an explanatory diagram explaining division of an image display region on a screen according to the embodiment of the present invention.

FIG. 13 is an explanatory diagram explaining the division of the detecting region on the screen according to the embodiment of the present invention. As shown in FIG. 13, in this embodiment, the detecting region on the screen is divided so that the number of pixels of one side becomes an exponentiation of 2.

Figure 15:
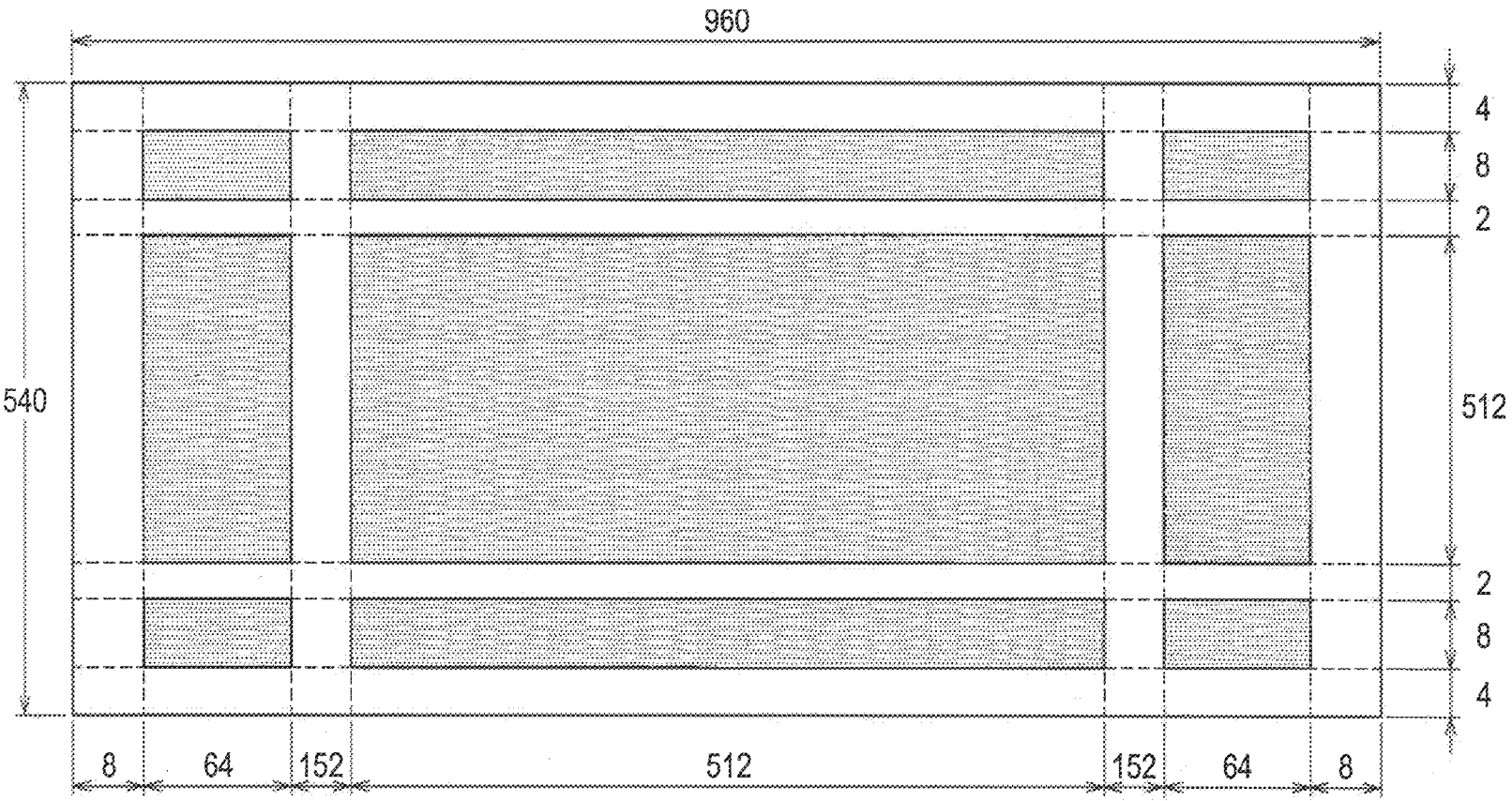
FIG. 15 is an explanatory diagram explaining division of the image display region on the screen according to the embodiment of the present invention.

FIG. 15 is an explanatory diagram explaining the division of the detecting region on the screen according to the embodiment of the present invention more specifically. As shown in FIG. 15, the display device 100 according to the embodiment of the present invention has the detecting region of 960 pixels horizontally and 540 pixels vertically. This detecting region is divided into nine regions so that the number of pixels on one side becomes an exponentiation of 2, as shown in FIG. 15.

In the example shown in FIG. 15, the divided regions include four regions which are 8 pixels vertically (8=23) and 64 pixels horizontally (64=26), two regions which are 512 pixels vertically (512=29) and 64 pixels horizontally, two regions which are 8 pixels vertically and 512 pixels horizontally, and one region which is 512 pixels vertically and horizontally. Note that in FIG. 15, the values shown on the dimensional lines do not necessarily coincide with actual lengths.

In this way, when the number of pixels on one side in each region is set to the exponentiation of 2, the number of pixels in each region as well becomes the exponentiation of 2, and thus calculation of the average value of the signal levels can easily be performed.

Accordingly, the average value of the signal levels of R, G, and B per pixel is calculated in each region. Because the region which is 8 pixels vertically and 64 pixels horizontally includes 512 pixels, the signal levels of R, G, and B are added and divided by 512 so that the average value of the signal levels is calculated.

It need hardly be mentioned that the number of divided regions and the number of pixels on one side in the present invention are not limited to the example shown in FIG. 15. Additionally, in FIG. 15, as a result of dividing the screen into a plurality of regions, the respective regions have a rectangular shape. However, the present invention is not limited to this, and the screen may be divided into a plurality of regions having a square shape.

Further, in this embodiment, the screen is divided into a plurality of regions so that the average values of the signal levels are calculated, but the average value of the signal levels on the entire screen may be calculated without dividing the screen into a plurality of regions. However, when the average value of the signal levels on the entire screen is calculated, even if a video in which only one portion of the screen moves is displayed, it is difficult to detect a still image. Therefore, it is desirable to divide the screen into a plurality of regions and calculate the average values of the signal levels.

The control unit 104 judges whether a region on which a still image is continuously displayed is present based on the information about the average value of R, G, and B in each divided region output from the still image detection unit 122. Accordingly, when even one region on which the still image is continuously displayed is present, correction coefficients (gains) Cr', Cg', and Cb' for reducing the luminance are calculated in order to prevent the burn-in phenomenon so as to be sent to the signal level correction unit 128. Cr' is a correction coefficient for multiplying a red video signal, Cg' is a correction coefficient for multiplying a green video signal, and Cb' is a correction coefficient for multiplying a blue video signal.

The control unit 104 includes a still image judging unit 162, and a coefficient calculation unit 164. The still image judging unit 162 judges whether an image displayed on the screen is a still image based on the average value output from the still image detection unit 122. When it is judged that the still image is displayed on the screen as a result of judgment by the still image judging unit 162, the coefficient calculation unit 164 calculates coefficients for reducing the luminance of an image displayed on the screen.

Still image judgment by the still image judging unit 162 is performed in the following manner. Firstly, the information about the average value of the signal levels of respective colors in each region sent from the still image detection unit 122 is temporarily stored in the storage unit 150. Next, the last average value of the signal levels of respective colors in each region stored in the storage unit 150 is compared with the present average value of the signal levels of respective colors in each region, and when they are different by a predetermined value or more, it is judged that a moving image is displayed. On the other hand, when they are different by less than the predetermined value, it is judged that a still image is displayed.

When judgment of whether an image displayed on the screen is a still image is made by the control unit 104, the control unit 104 changes a value indicating a display degree of the still image according to the judged result. The display degree of still image is termed "the degree of still image." The degree of still image is changed so that the control unit 104 calculates a gain according to the degree of still image. When the gains are calculated according to the degree of still image, the luminance of an image displayed through the panel 158 is adjusted so that the burn-in phenomenon can be prevented.

The degree of still image is stored in the storage unit 150. Because the degree of still image may be retained as information while the display device 100 is operating, it is desirable to store it in the storage unit 150 having volatility.

The signal level correction unit 128 inputs the video signal and the gain calculated by the control unit 104, and multiplies the input video signal by the gain so as to output the video signal multiplied by the gain. When the signal level correction unit 128 multiplies the video signal by the gain, the signal level of the video signal is reduced, so that the luminance of the image displayed on the screen can be reduced. As a result, deterioration in the organic EL elements is suppressed so that the burn-in phenomenon can be prevented.

The signal level correction unit 128 and the structural elements relating to the signal level correction unit 128 according to the embodiment of the present invention are described above. Next, a still image judging method according to the embodiment of the present invention will be described.

Figure 14:
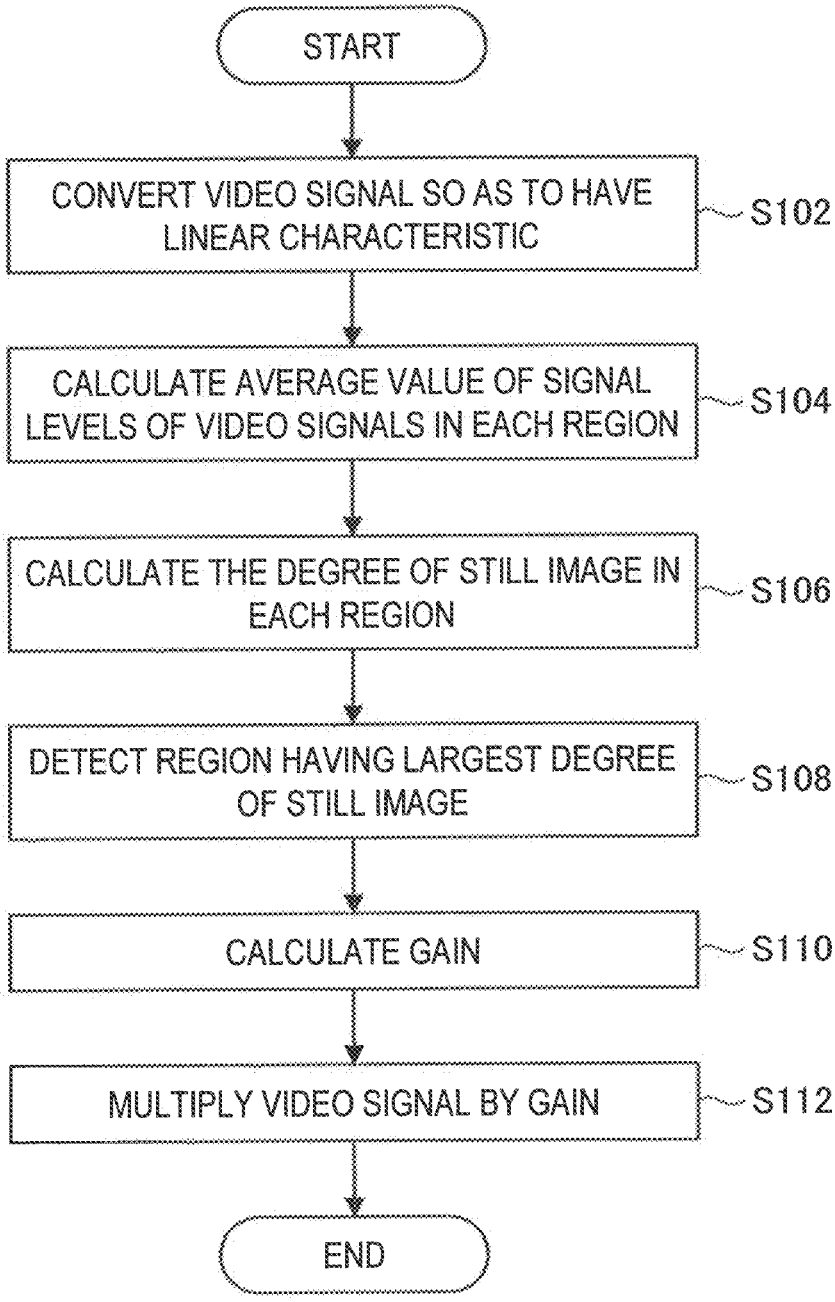
FIG. 14 is a flow chart explaining a still image judging method according to the embodiment of the present invention.

FIG. 14 is a flow chart explaining the still image judging method according to the embodiment of the present invention. Firstly, the linear conversion unit 116 executes the converting process on a video signal having a gamma characteristic so that the video signal has a linear characteristic (step S102).

Next, the still image detection unit 122 calculates the average value of the signal levels in each region based on the signal levels of R, G, and B using the video signals input into the still image detection unit 122 (step S104). The average value of the signal levels is calculated by dividing the added signal levels in one region by the number of pixels.

In this embodiment, the signal level of one color per frame can be acquired from the input video signal. Consequently, the video signals for three frames are necessary for acquiring the signal levels of R, G, and B.

Figure 16A:
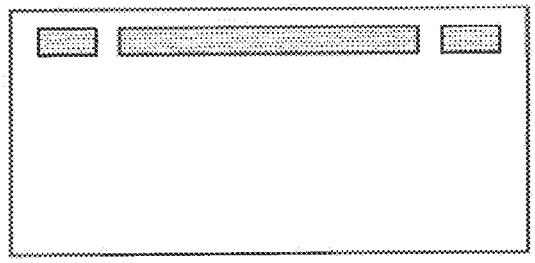
FIG. 16A is an explanatory diagram explaining a measuring order of the signal level in each region according to the embodiment of the present invention.
Figure 16B:
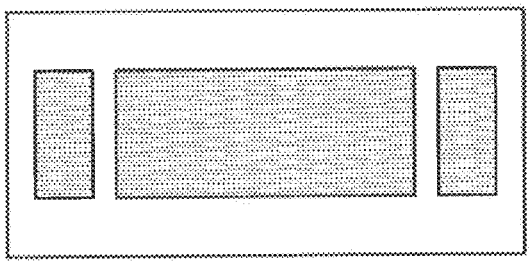
FIG. 16B is an explanatory diagram explaining a measuring order of the signal level in each region according to the embodiment of the present invention.
Figure 16C:
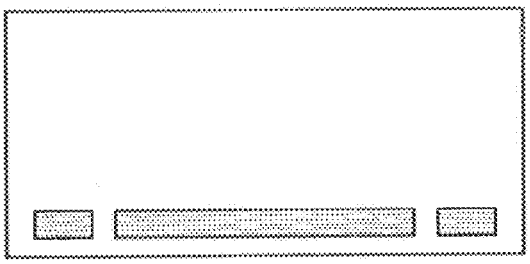
FIG. 16C is an explanatory diagram explaining a measuring order of the signal level in each region according to the embodiment of the present invention.
Figure 17:
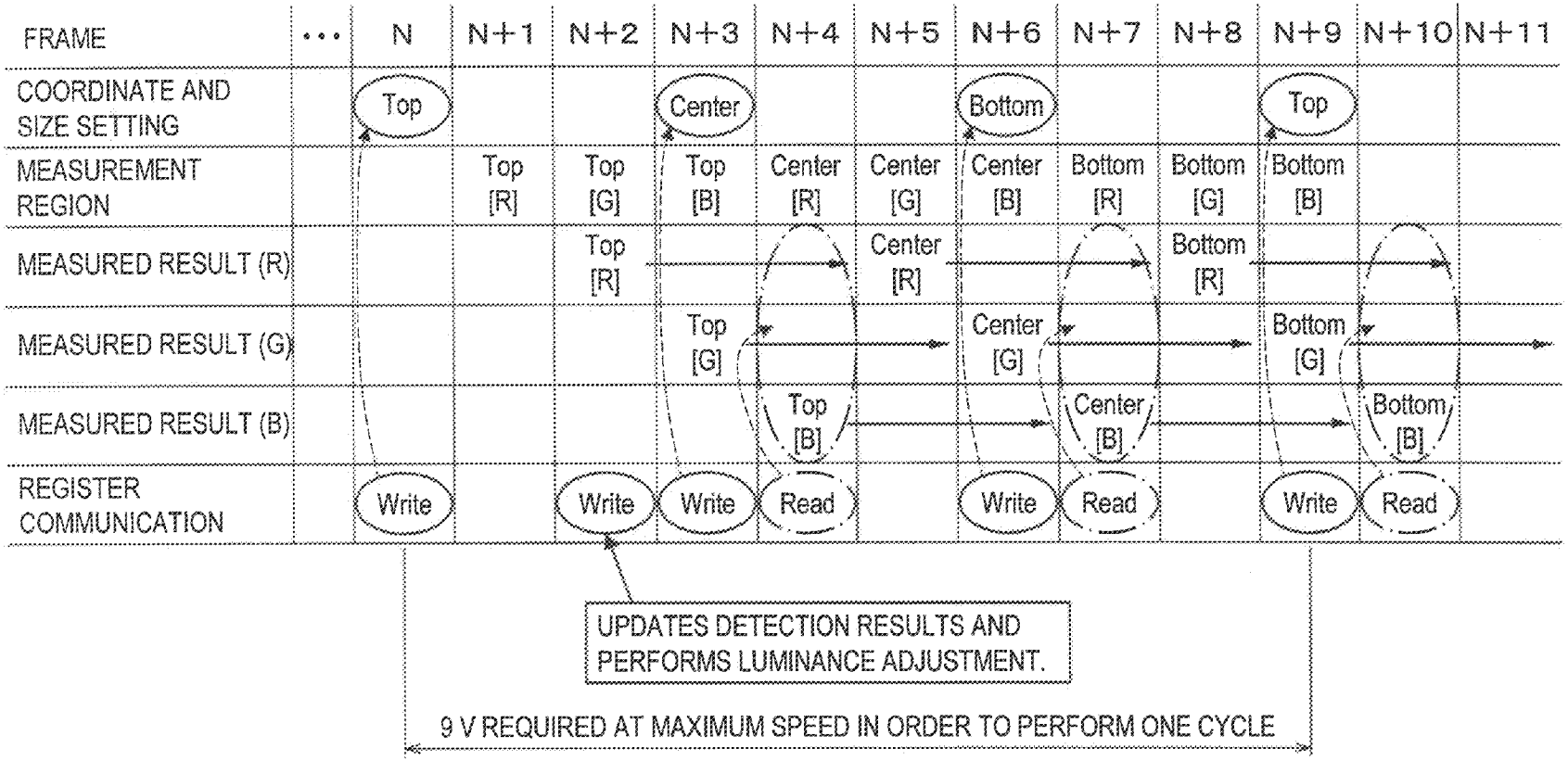
FIG. 17 is an explanatory diagram explaining the measurement of the signal level in a still image detection unit 122 according to the embodiment of the present invention.

FIG. 16A, FIG. 16B, and FIG. 16C are explanatory diagrams explaining the measuring order of the signal levels in each region according to the embodiment of the present invention. FIG. 17 is an explanatory diagram explaining the measurement of the signal levels in the still image detection unit 122. The flow of the measurement of the signal levels in the still image detection unit 122 will be described with reference to FIG. 16A, FIG. 16B, FIG. 16C, and FIG. 17.

At the time point when the video signal of the Nth frame is input into the still image detection unit 122, setting of a coordinate and a size for the measurement is performed. In the example shown in FIG. 17, at the time when the video signal of the Nth frame is input into the still image detection unit 122, the measurement in a Top region, namely, a region shown in FIG. 16A is started.

Next, at the time point when the video signal of the (N+1)th frame is input into the still image detection unit 122, a level of a red (R) video signal in the Top region shown in FIG. 16A is measured. At the time point when the video signal of the (N+2)th frame is input, a level of a green (G) video signal in the Top region is measured. At the time point when the video signal of the (N+3)th frame is input, a level of a blue (B) video signal in the Top region is measured. The respective values obtained by the measurements are temporarily retained in the still image detection unit 122. The measured results can be obtained at the time points when the respective video signals of the (N+2)th, the (N+3)th, and the (N+4)th frames are input.

Accordingly, at the time point when the video signal of the (N+4)th frame is input, the values of the signal levels of three colors R, G, and B in the Top region are available, and thus the signal levels of the respective colors R, G, and B are obtained.

At the time point when the video signal of the (N+3)th frame is input, an instruction is given for starting the measurement in a Center region, namely, the region shown in FIG. 16B.

Next, at the time point when the video signal of the (N+4)th frame is input, a level of a red (R) video signal in the Center region is measured. At the time point when the video signal of the (N+5)th frame is input, a level of a green (G) video signal in the Center region is measured. At the time point when the video signal of the (N+6)th frame is input, a level of a blue (B) video signal in the Center region is measured. The values obtained by the measurements are retained. The measured results can be obtained at the time points when the respective video signals of the (N+5)th, the (N+6)th, and the (N+7)th frames are input.

Accordingly, at the time point when the video signal of the (N+7)th frame is input, the values of the signal levels of three colors R, G, and B in the Center region are available, and thus the values of the signal levels of the respective colors R, G, and B are obtained.

At the time point when the video signal of the (N+6)th frame is input, an instruction is given for starting the measurement in a Bottom region, namely, the region shown in FIG. 16C.

Next, at the time point when the video signal of the (N+7)th frame is input, a level of a red (R) video signal in the Bottom region is measured. At the time point when the video signal of the (N+8)th frame is input, a level of a green (G) video signal in the Bottom region is measured. At the time point when the video signal of the (N+9)th frame is input, a level of a blue (B) video signal in the Bottom region is measured. The values obtained by the measurements are retained. The measured results can be obtained at the time points when the video signals of the (N+8)th, the (N+9)th, and the (N+10)th frames are input.

Accordingly, at the time point when the video signal of the (N+10)th frame is input, the values of the signal levels of three colors R, G, and B in the Bottom region are available, and thus the values of the signal levels of the respective colors R, G, and B are obtained.

In this embodiment, in this manner, because the signal levels in the nine regions on the screen are obtained, the video signals for nine frames are necessary for obtaining the signal levels of three colors R, G, and B in the nine regions. For this reason, the still image detection unit 122 successively acquires the signal levels of three colors R, G, and B in the nine regions on the screen in a time cycle of nine frames.

When the still image detection unit 122 acquires the signal levels of three colors R, G, and B in each region on the screen, the average values of the acquired signal levels are successively calculated for respective regions. Then, the calculated average values of the signal levels are sent from the still image detection unit 122 to the control unit 104.

Here, it need hardly be mentioned that the calculation timing of the average values of the signals levels is not limited to one type of timing. For example, the average values of the signal levels may be successively calculated at the time point when the signal levels of respective colors are completely acquired, or at the time point when the signal levels of R, G, and B are completely acquired in one region, or at the time point when the signal levels of R, G, and B are completely acquired in one screen, namely, all the nine regions.

When acquiring the average values of the signal levels in respective regions from the still image detection unit 122, the control unit 104 judges whether a still image is displayed on the screen using the acquired average values of the signal levels in the respective regions. In this embodiment, a difference between the last average value of the signal levels and the present average value of the signal levels is acquired, and the judgment of still image is made based on whether the difference is not less than a predetermined amount.

When the difference of any one color among the three colors R, G, and B is not less than the predetermined amount, the control unit 104 judges that a moving image is displayed on the screen based on the present video signal. When the differences of all colors R, G, and B are less than the predetermined amount, the still image judging unit 162 judges that a still image is displayed on the screen based on the present video signals.

In this embodiment, because the signal levels of respective colors in all the regions on the screen can be acquired in the time cycle of 9 frames, the judgment of a still image in the still image judging unit 162 is also made in the time cycle of 9 frames.

Figure 18:
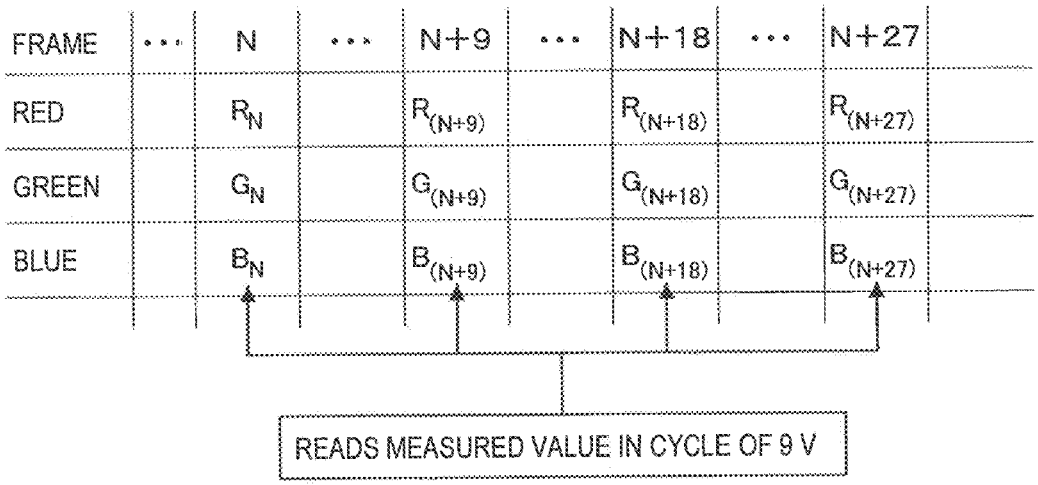
FIG. 18 is an explanatory diagram explaining the determination of a still image according to the embodiment of the present invention.

FIG. 18 is an explanatory diagram explaining the judgment of a still image according to the embodiment of the present invention. FIG. 18 describes the case where attention is focused on one region in the nine regions on the screen set in this embodiment, and the average values of the signal levels of R, G, and B are compared in the cycles of 9 frames (cycle of 9 V) so that the judgment of a still image is made.

In FIG. 18, $R_N$ shows the average value of the red (R) signal levels at the time point when the video signal of the Nth frame is input. Similarly, $G_N$ shows the average value of the green (G) signal levels at the time point when the video signal of the Nth frame is input, and $B_N$ shows the average value of the blue (B) signal levels at the time point when the video signal of the Nth frame is input.

Because the average values of the signal levels of R, G, and B are compared in the cycle of 9 frames (cycle of 9 V), the still image judging unit 162 compares $R_N$, which is the average value of the red signal levels at the time point when the video signal of the Nth frame is input, with $R_{N+9}$, which is the average value of the red signal levels at the time point when the video signal of the (N+9)th frame is input. Similarly, the still image judging unit 162 compares $G_N$ with $G_{N+9}$, which is the average value of the green signal levels at the time point when the video signal of the (N+9)th frame is input, and compares $B_N$ with $B_{N+9}$, which is the average value of the blue signal levels at the time point when the video signal of the (N+9)th frame is input.

As a result of comparing both, when the differences of the average values of the signal levels of respective colors are not less than a predetermined amount, the still image judging unit 162 judges that a moving image is displayed on the region on the screen. On the other hand, when the differences in all the colors R, G, and B are less than the predetermined amount, the control unit 104 judges that a still image is displayed on the region on the screen.

When the still image judging unit 162 makes the still image judgment, it then calculates the degree of still image in the respective regions on the screen according to the result of the still image judgment (step S106). The degree of still image is the degree of the display of a still image, and as the degree of still image is larger, a still image is displayed on that region continuously.

As a result of the still image judgment in the still image judging unit 162, in a case when it is judged that a still image is displayed on a certain region being subject to the judgment, the degree of still image stored in the storage unit 150 is increased by a predetermined amount. On the other hand, as a result of the still image judgment in the control unit 104, in a case when it is judged that a moving image is displayed on a certain region being subject to the judgment, the degree of still image stored in the storage unit 150 is decreases by a predetermined amount. Here, in the present invention, the increasing amount and the decreasing amount of the degree of still image may be equal to each other, or may be different values from each other. In this embodiment, the increasing amount of the degree of still image is larger than the decreasing amount.

Figure 19:
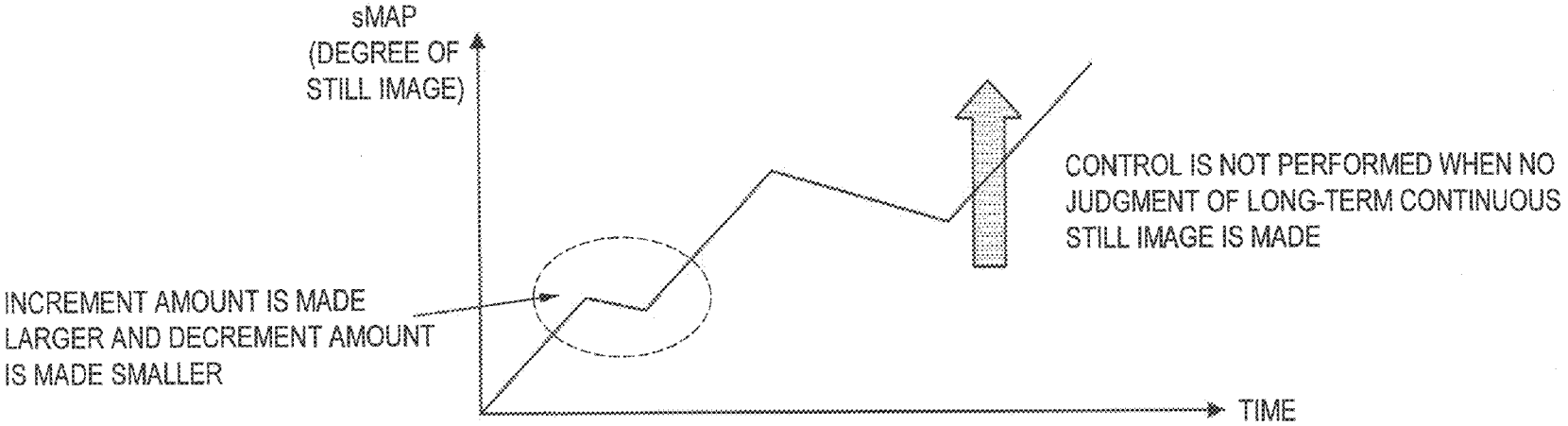
FIG. 19 is an explanatory diagram depicting, using a graph, a relationship between the degree of still image and time according to the embodiment of the present invention.

FIG. 19 is an explanatory diagram depicting, using a graph, a relationship between the degree of still image and the time according to the embodiment of the present invention. In the graph depicted in FIG. 19, the abscissa axis represents the time, and the ordinate axis represents the degree of still image (sMAP), and the graph shows a state that the degree of still image increases or decreases over the time. As shown in FIG. 19, when the control unit 104 judges that a still image is displayed continuously, the control unit 104 calculates gains as is described later. Additionally, when the degree of still image is updated, the increasing amount of the degree of still image is set to be larger than the decreasing amount, and thus if a moving image is not displayed for a longer time than the time for which a still image is displayed, the degree of still image does not return to an original level. Thus, the burn-in phenomenon on the screen due to the display of a still image can be effectively suppressed.

When the still image judging unit 162 updates the degree of still image in each region on the screen stored in the storage unit 150, the coefficient calculation unit 164 then detects the degree of still image in each region on the screen stored in the storage unit 150 so as to check the presence of the region on which the still image is continuously displayed. When the coefficient calculation unit 164 can confirm that a still image is continuously displayed on at least one region on the screen, the coefficient calculation unit 164 calculates gains for reducing the luminance of an image displayed on the screen of the display device 100. The coefficient calculation unit 164 calculates the gains for R, G, and B colors.

Only the gains for reducing the luminance only in the regions where the still image is displayed may be calculated, or the gains for reducing the luminance on the entire screen may be calculated. However, when only the luminance in the regions where the still image is displayed is reduced, a sense of discomfort is possibly given to a person who views the image displayed on the display device 100. Therefore, it is desirable that the gains for reducing the luminance on the entire screen are also calculated, and after the luminance on the entire screen is reduced a little, the luminance only in the region where the still image is displayed is reduced.

In this embodiment, two kinds of gains, namely, the gain for reducing the luminance on the entire screen and the gain for reducing the luminance only in the region where the still image is displayed, are calculated.

The gain calculating method in this embodiment is described specifically. First, the coefficient calculation unit 164 acquires a region, which has the largest degree of still image in the degrees of still images in the nine regions on the screen stored in the storage unit 150, and its degree of still image (step S108). When acquiring the region having the largest degree of still image and its degree of still image, the coefficient calculation unit 164 calculates the correction coefficients (gains) Cr', Cg', and Cb' for multiplying video signals in the signal level correction unit 128 (step S110).

Note that when the luminance is adjusted according to the largest degree of still image and a moving image is displayed in the region where the still image has been displayed, the degree of still image is reduced, and thus the gains which are calculated become large according to the reduction in the degree of still image. As a result, the luminance of the image displayed on the screen rapidly increases, and the screen is seemed to be flashed. For this reason, it is desirable that the gains are not increased rapidly, but the gains are increased gradually.

One method for increasing the gains gradually is a method for comparing the maximum value of the acquired degree of still image with the maximum value of the degree of still image acquired last time, and calculating the gains according to the compared result.

The maximum value of the latest degree of still image is represented by sMAP_MAX_NEW, and the maximum value of the degree of still image acquired last time is represented by sMAP_MAX_OLD. The sMAP_MAX_NEW is compared with the sMAP_MAX_OLD, and when the sMAP_MAX_NEW is less than the sMAP_MAX_OLD, the value obtained by subtracting a predetermined amount from the sMAP_MAX_OLD is set to the degree of still image to be used for calculating the gains. On the other hand, when the sMAP_MAX_NEW is not less than the sMAP_MAX_OLD, the sMAP_MAX_NEW is directly set to the degree of still image used for calculating the gains. The degree of still image used for calculating the gains is represented by sMAP_MAX'.

In this manner, the maximum value of the acquired degree of still image is compared with the maximum value of the degree of still image acquired last time, and the gains are calculated according to the compared result. Thus, it is possible to prevent the phenomenon in which the luminance of an image displayed on the screen increases rapidly at the time point when the display is switched from a still image to a moving image and thus the screen is seemed to be flashed. Note that the predetermined amount which is subtracted from the sMAP_MAX_OLD can be set freely according to a design.

Figure 20:
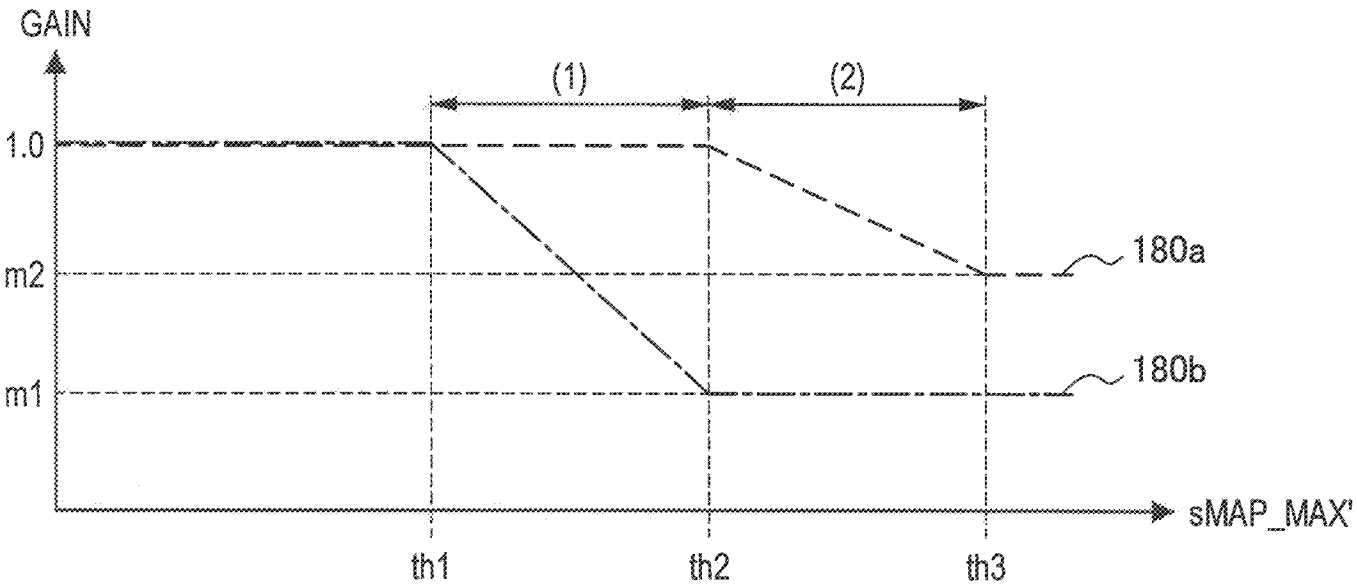
FIG. 20 is an explanatory diagram depicting, using a graph, a relationship between the degree of still image and a gain according to the embodiment of the present invention.

FIG. 20 is an explanatory diagram depicting, using a graph, a relationship between the degree of still image and the gain according to the embodiment of the present invention. The abscissa axis of the graph shown in FIG. 20 represents the degree of still image sMAP_MAX' to be used for calculating the gains, and the ordinate axis represents the gain to be calculated.

A line shown by a symbol 180*a* in FIG. 20 shows the relationship between the degree of still image and the gain at the time of calculating the gains for reducing the luminance on the entire screen. A line shown by a symbol 180*b* shows the relationship between the degree of still image and the gain at the time of calculating the gains for reducing the luminance in a region having high degree of still image, namely, a region where one still image is continuously displayed.

A zone shown by (1) in FIG. 20, namely, a zone where the value of sMAP_MAX' is between th1 to th2, is a zone where the gain for reducing the luminance of an image displayed on the region with high degree of still image is calculated. While the degree of still image sMAP_MAX' is between 0 to th1, the gain to be calculated is 1.0. When the degree of still image increases and the degree of still image sMAP_MAX' reaches th1, the gain having a value smaller than 1.0 is calculated in order to reduce the luminance of an image displayed on the region with high degree of still image. The value of the gain is reduced from 1.0 to m2 until the degree of still image sMAP_MAX' reaches th2.

A zone shown by (2) in FIG. 20, namely, a zone where the value of sMAP_MAX' is between th2 and th3, is a zone where the gain for reducing the luminance on the entire screen is calculated. While the degree of still image sMAP_MAX' is between 0and th2, the gain to be calculated is 1.0. When the degree of still image increases and the degree of still image sMAP_MAX' reaches th2, the gain having a value smaller than 1.0 is calculated in order to reduce the luminance on the entire screen. When the degree of still image sMAP_MAX' is larger than th2, the value of the gain to be calculated is reduced from 1.0 to m1 until the degree of still image sMAP_MAX' reaches th3.

When two kinds of gains are calculated in this manner, the luminance can be adjusted while a user who views the image on the display device 100 does not sense deterioration in the luminance of the video displayed on the screen.

When the coefficient calculation unit 164 calculates the correction coefficients Cr', Cg', and Cb', it inputs the calculated correction coefficients Cr', Cg', and Cb' into the signal level correction unit 128. The signal level correction unit 128 multiples the video signals by the input correction coefficients Cr', Cg', and Cb' (step S112).

The signal level correction unit 128 multiplies the respective colors R, G, and B by the correction coefficients Cr', Cg', and Cb'. That is to say, the red video signal is multiplied by the correction coefficient Cr' for correcting the red signal level, the green video signal is multiplied by the correction coefficient Cg' for correcting the green signal level, and the blue video signal is multiplied by the correction coefficient Cb' for correcting the blue signal level.

The signal level correction unit 128 multiplies the video signals by the correction coefficients, so as to adjust the levels of the video signals input into the signal level correction unit 128. As a result of the multiplication by the correction coefficients in the signal level correction unit 128, the levels of the video signals are adjusted, and the luminance of a video displayed through the panel 158 can be reduced.

The still image judging method according to the embodiment of the present invention has been described above. Note that in the above-described still image judging method, a computer program which is created for executing the still image judging method according to the embodiment of the present invention may be recorded in a recording medium (for example, the recording unit 106) in the display device 100 in advance, and an operating device (for example, the control unit 104) may successively read and execute the computer program.

As was described above, according to the embodiment of the present invention, the immediately previous levels of the video signals are compared with the present levels of video signals, and whether a still image is displayed is judged based on the difference between both the levels. Accordingly, the degree of still image is updated according to the judged result, so that whether the still image is continuously displayed on the screen can be detected. Accordingly, when the correction coefficients (gains) for reducing the luminance in a region where a still image is displayed are calculated according to the degree of still image, the luminance of a video displayed on the screen is reduced, so that the burn-in phenomenon can be prevented.

Additionally, because the various signal processes on the video signals having linear characteristic are executed by simple operations, the circuit which performs the operations may have a simple circuit configuration. This results in reducing the entire area of the circuit, and thus the display device 100 is thinned and light weighted.

The preferred embodiment of the present invention is described above with reference to the appended drawings. However, it is needless to mention that the present invention is not limited to the above-described examples. It should be understood by those skilled in the art that various modifications, combinations, sub-combinations, and alternations may occur depending on design requirements and other factors insofar as they are within the scope of the appended claims or the equivalents thereof.

For example, in the above-described embodiment, the still image judging unit 162 calculates the degree of still image, calculates correction values based on the calculated degree of still image, and sends the calculated correction values to the signal level correction unit 128. The signal level correction unit 128 multiples video signals by the correction values so as to correct the levels of the video signals. However, the present invention is not limited to this example. For example, the control unit 104 may calculate the degree of still image and send the calculated degree of still image to the signal level correction unit 128, with calculation and multiplication of the correction values being performed at the signal level correction unit 128.

The invention claimed is:

1. A display device which has a display unit in which pixels which have light emitting elements that self-emit light according to an electric current amount and pixel circuits for controlling an electric current applied to the light emitting elements according to video signals, scanning lines which supply selection signals for selecting the pixels that are caused to emit light to the pixels in a predetermined scanning cycle, and data lines which supply the video signals to the pixels are arranged into a matrix pattern, the display device comprising:

an average value calculation unit which inputs video signals having linear characteristic and calculates an average value of signal levels of the video signals having linear characteristic in each of the pixels;

an average value storage unit which sequentially stores the average values calculated by the average value calculation unit;

a still image judging unit which judges whether a still image is displayed on a present screen by dividing the display unit into a plurality of regions and judging whether a still image is displayed on each of the plurality of regions based on a difference between the average value stored in the average value storage unit and a last average value;

a storage unit that stores a value for respective regions of the plurality of regions, wherein when the still image judging unit judges that a still image is displayed on a respective one of the plurality of regions, the value is increased by a first predetermined amount, and when the still image judging unit judges that a moving image is displayed on the respective one of the plurality of regions, the value is decreased by a second predetermined amount;

a coefficient calculation unit which, when it is judged that a still image is displayed on the present screen as a result of the judgment in the still image judging unit, calculates coefficients for reducing luminance of an image displayed on the display unit based on the value; and a coefficient multiplying unit which multiplies the video signals by the coefficients calculated by the coefficient calculation unit, wherein when the still image judging unit judges that the still image is displayed on at least one of the plurality of regions, the still image judging unit judges that the still image is displayed on the entire screen, and wherein coefficients for reducing luminance for the respective one of the plurality of regions is decreased as the value is increased beyond a first threshold, and coefficients for reducing luminance for the entire screen are decreased as the value is increased beyond a second threshold which is higher than the first threshold.

2. The display device according to claim 1, further comprising:

a linear conversion unit which converts video signals having gamma characteristic into the video signals having linear characteristic.

3. The display device according to claim 1, further comprising:

a gamma conversion unit which converts output signals of the coefficient multiplying unit having linear characteristic into signals having gamma characteristic.

4. The display device according to claim 1, wherein the coefficient calculation unit calculates correction coefficients for reducing the luminance in a region where an image having the highest luminance is displayed.

5. The display device according to claim 4, wherein the coefficient calculation unit calculates correction coefficients for reducing the luminance of the entire screen.

6. The display device according to claim 1, wherein the still image judging unit divides the display unit into a plurality of regions where a number of pixels of one side of each of the plurality of regions is an exponentiation of 2.

7. The display device according to claim 1, wherein the first predetermined amount is equal to the second predetermined amount.

8. The display device according to claim 1, wherein the first predetermined amount is not equal to the second predetermined amount.

9. The display device according to claim 1, wherein the first predetermined amount is greater than the second predetermined amount.

10. The display device according to claim 1, wherein the value indicates a display degree of the still image.

11. A driving method for a display device, the display device having a display unit in which pixels which have light emitting elements that self-emit light according to an electric current amount and pixel circuits for controlling an electric current applied to the light emitting elements according to video signals, scanning lines which supply selection signals for selecting the pixels that are caused to emit light to the pixels in a predetermined scanning cycle, and data lines which supply the video signals to the pixels are arranged into a matrix pattern, the driving method comprising the steps of:

inputting video signals having linear characteristic and calculating an average value of signal levels of the video signals in each of the pixels;

storing the average values calculated at the average value calculating step;

judging whether a still image is displayed on the display unit by dividing the display unit into a plurality of regions and judging whether a still image is displayed on each of the plurality regions based on a difference between the average value stored at the average value storing step and a last average value;

storing a value for respective regions of the plurality of regions;

when it is judged that a still image is displayed on a respective one of the plurality of regions, increasing the value by a first predetermined amount;

when it is judged that a moving image is displayed on the respective one of the plurality of regions, decreasing the value by a second predetermined amount;

when it is judged that a still image is displayed on the display unit as a result of the judgment at the still image judging step, calculating coefficients for reducing luminance of an image displayed on the display unit based on the value; and multiplying the video signals by the coefficients calculated at the coefficient calculating step, wherein when it is judged that the still image is displayed on at least one of the plurality of regions, it is judged that the still image is displayed on the entire screen, and wherein coefficients for reducing luminance for the respective one of the plurality of regions is decreased as the value is increased beyond a first threshold, and coefficients for reducing luminance for the entire screen are decreased as the value is increased beyond a second threshold which is higher than the first threshold.

12. The driving method for the display device according to claim 11, further comprising the step of:

converting video signals having gamma characteristic into the video signals having linear characteristic.

13. The driving method for the display device according to claim 11, further comprising the step of:

converting output signals of the coefficient multiplying step having linear characteristic so as to have gamma characteristic.

14. The driving method for the display device according to claim 11, wherein the coefficient calculating step calculates correction coefficients for reducing the luminance in a region where an image having the highest luminance is displayed.

15. The driving method for the display device according to claim 14, wherein the coefficient calculating step calculates correction coefficients for reducing the luminance of the entire screen.

16. The driving method for the display device according to claim 11, wherein the still image judging step divides the display unit into a plurality of regions where a number of pixels of one side is an exponentiation of 2.

17. A non-transitory computer readable storage medium that stores a program which causes a computer to execute control of a display device having a display unit in which pixels which have light emitting elements that self-emit light according to an electric current amount and pixel circuits for controlling an electric current applied to the light emitting elements according to video signals, scanning lines which supply selection signals for selecting the pixels that are caused to emit light to the pixels in a predetermined scanning cycle, and data lines which supply the video signals to the pixels are arranged into a matrix pattern, the computer program comprising the steps of:

inputting video signals having linear characteristic and calculating an average value of signal levels of the video signals in each of the pixels;

storing the average values calculated at the average value calculating step;

judging whether a still image is displayed on the display unit by dividing the display unit into a plurality of regions and judging whether a still image is displayed on each of the plurality of regions based on a difference between the average value stored at the average value storing step and a last average value;

storing a value for respective regions of the plurality of regions;

when it is judged that a still image is displayed on a respective one of the plurality of regions, increasing the value by a first predetermined amount;

when it is judged that a moving image is displayed on the respective one of the plurality of regions, decreasing the value by a second predetermined amount;

when it is judged that a still image is displayed on the display unit as a result of the judgment at the still image judging step, calculating coefficients for reducing luminance of an image displayed on the display unit based on the value; and multiplying the video signals by the coefficients calculated at the coefficient calculating step, wherein when it is judged that the still image is displayed on at least one of the plurality of regions, it is judged that the still image is displayed on the entire screen, and wherein coefficients for reducing luminance for the respective one of the plurality of regions is decreased as the value is increased beyond a first threshold, and coefficients for reducing luminance for the entire screen are decreased as the value is increased beyond a second threshold which is higher than the first threshold.

18. The non-transitory computer readable storage medium that stores the program which causes the computer to execute control of the display device according to claim 17, wherein the still image judging step divides the display unit into a plurality of regions where a number of pixels of one side is an exponentiation of 2.

* * * * *